US009055789B2

(12) United States Patent
Danforth, Jr. et al.

(10) Patent No.: US 9,055,789 B2
(45) Date of Patent: Jun. 16, 2015

(54) CONNECTION DEVICE FOR HOLDING AN OBJECT, SUCH AS A KEY, DOG TAG, AND THE LIKE

(75) Inventors: Douglas D. Danforth, Jr., Prairie Village, KS (US); Warren V. Moore, Lenexa, KS (US); David R. Peck, Olathe, KS (US); Dale W. Sass, Gardner, KS (US)

(73) Assignee: AHA LLC, Fairway, KS (US)

( * ) Notice: Subject to any disclaimer, the term of this patent is extended or adjusted under 35 U.S.C. 154(b) by 462 days.

(21) Appl. No.: 13/168,396

(22) Filed: Jun. 24, 2011

(65) Prior Publication Data

US 2011/0314879 A1 Dec. 29, 2011

Related U.S. Application Data

(60) Provisional application No. 61/358,757, filed on Jun. 25, 2010, provisional application No. 61/434,693, filed on Jan. 20, 2011, provisional application No. 61/487,850, filed on May 19, 2011.

(51) Int. Cl.
*A44B 15/00* (2006.01)

(52) U.S. Cl.
CPC ..... *A44B 15/00* (2013.01)

(58) Field of Classification Search
CPC .... A44B 15/00; A44B 15/005; A44B 15/002; A45F 5/02; A47G 29/10; G09F 3/00; A45C 11/324; A45C 11/323; A45C 11/328; A45C 11/32; A45C 11/326; A45C 11/321
USPC ..... 70/456 R, 457, 458, 459, 460; 24/3.6, 24/3.12, 576.1, 591.1, 594.1; 206/37.1–37.8, 38.1; 410/107, 111; 63/14.4, 14.5
See application file for complete search history.

(56) References Cited

U.S. PATENT DOCUMENTS

| | | | | |
|---|---|---|---|---|
| 35,150 | A * | 5/1862 | Frazer | 29/3 |
| 271,121 | A * | 1/1883 | Riley et al. | 63/12 |
| 368,135 | A * | 8/1887 | Crandall | 70/459 |
| 534,452 | A * | 2/1895 | Schlarbaum | 70/459 |
| 1,373,867 | A * | 4/1921 | Conner | 70/456 R |
| 2,048,599 | A * | 7/1936 | Collins | 70/456 R |
| 2,115,342 | A * | 4/1938 | Moore | 70/456 R |

(Continued)

FOREIGN PATENT DOCUMENTS

JP 2000262311 A 9/2000

OTHER PUBLICATIONS

PCT Search Report and Written Opinion from PCT Application No. PCT/US2011/041806 entitled Connection Device for Holding an Object, Such as a Key, Dog Tag, and the Like (Dated Feb. 27, 2012).

(Continued)

*Primary Examiner* — Lloyd Gall
(74) *Attorney, Agent, or Firm* — Hovey Williams LLP

(57) ABSTRACT

Connection devices for holding objects, such as, for instance, keys or dog tags, are disclosed. The connection device includes a ring presenting spaced apart ends defining an opening therebetween through which objects may be added or removed to the connection device. The device also includes a body with a blocking portion configured to adequately span the ring opening to selectively prohibit addition or removal of objects from the ring. The ring and body are shiftably interconnected at a hinged connection.

91 Claims, 18 Drawing Sheets

(56) References Cited

U.S. PATENT DOCUMENTS

| | | | | | |
|---|---|---|---|---|---|
| 2,218,932 | A | * | 10/1940 | Collins | 70/456 R |
| 2,232,668 | A | | 2/1941 | Schupbach | |
| 2,307,808 | A | * | 1/1943 | Segal | 24/600.6 |
| 2,451,091 | A | * | 10/1948 | Johnson | 70/456 R |
| 2,457,195 | A | | 12/1948 | Bagnall | |
| 2,482,386 | A | * | 9/1949 | Vaisey et al. | 24/600.4 |
| 2,503,211 | A | | 4/1950 | Ormsbee | |
| 2,531,325 | A | * | 11/1950 | De Cesaris | 70/459 |
| 2,620,650 | A | * | 12/1952 | Cotti | 70/459 |
| 2,791,899 | A | * | 5/1957 | Marien | 70/459 |
| 2,923,045 | A | * | 2/1960 | Mount | 24/581.1 |
| 3,362,201 | A | * | 1/1968 | Lachin | 70/459 |
| 3,430,470 | A | * | 3/1969 | Muckleston | 70/459 |
| 3,513,675 | A | | 5/1970 | Ryder, Jr. et al. | |
| 3,516,272 | A | | 6/1970 | Modrey | |
| 3,597,951 | A | * | 8/1971 | Nadel | 70/459 |
| 3,899,802 | A | * | 8/1975 | Koehle | 24/599.9 |
| 4,077,243 | A | | 3/1978 | Tyson | |
| 4,091,646 | A | * | 5/1978 | Sugimoto | 70/456 R |
| 4,113,156 | A | * | 9/1978 | Brito | 224/666 |
| 4,129,021 | A | * | 12/1978 | Brentini | 70/456 R |
| 4,422,315 | A | * | 12/1983 | Klose | 70/456 R |
| 4,433,498 | A | * | 2/1984 | Bienz | 40/634 |
| 4,656,853 | A | * | 4/1987 | Mancini | 70/456 R |
| 4,821,543 | A | * | 4/1989 | Scungio | 70/456 R |
| 4,984,442 | A | * | 1/1991 | Benson | 70/456 R |
| 5,170,644 | A | * | 12/1992 | Calabro | 63/14.4 |
| 5,367,896 | A | | 11/1994 | Sundberg | |
| 5,488,848 | A | * | 2/1996 | Huang | 70/456 R |
| 5,495,734 | A | * | 3/1996 | Yu | 70/456 R |
| D383,599 | S | | 9/1997 | Song | |
| D383,600 | S | | 9/1997 | Song | |
| 5,685,185 | A | * | 11/1997 | MacDonald | 70/459 |
| 6,283,348 | B1 | * | 9/2001 | Wang | 224/271 |
| 6,763,692 | B1 | | 7/2004 | Huang | |
| 6,848,287 | B1 | | 2/2005 | Huang | |
| D668,038 | S | * | 10/2012 | Danforth et al. | D3/208 |
| D677,460 | S | * | 3/2013 | Danforth et al. | D3/208 |
| 8,402,800 | B1 | * | 3/2013 | Hester | 70/408 |
| 2004/0118173 | A1 | * | 6/2004 | Huang | 70/456 R |
| 2009/0320770 | A1 | | 12/2009 | Rolain et al. | |
| 2010/0031476 | A1 | | 2/2010 | Coldiron | |
| 2014/0109359 | A1 | * | 4/2014 | Danforth et al. | 24/576.1 |

OTHER PUBLICATIONS

Printout from Aspen Pet Brand website (www.aspenpet.com) of "TAGNABBIT" tag ring (printed Jul. 30, 2010).

Product Packaging for "TAGABINER" pet tag holder ( Publicly available at least as early as Apr. 6, 2010).

* cited by examiner

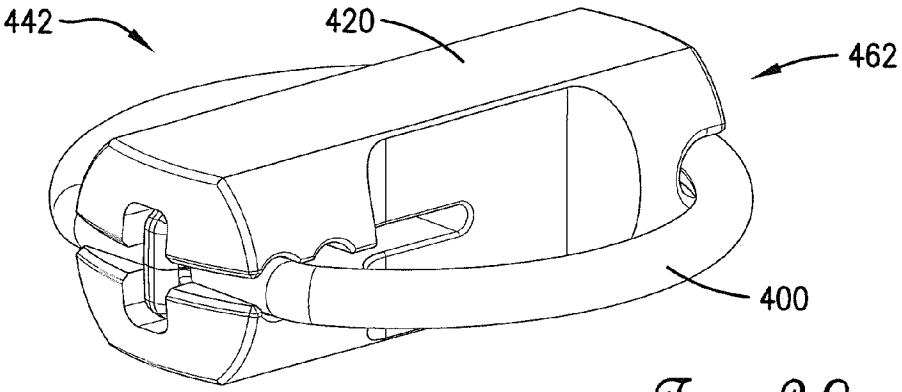
Fig. 20.
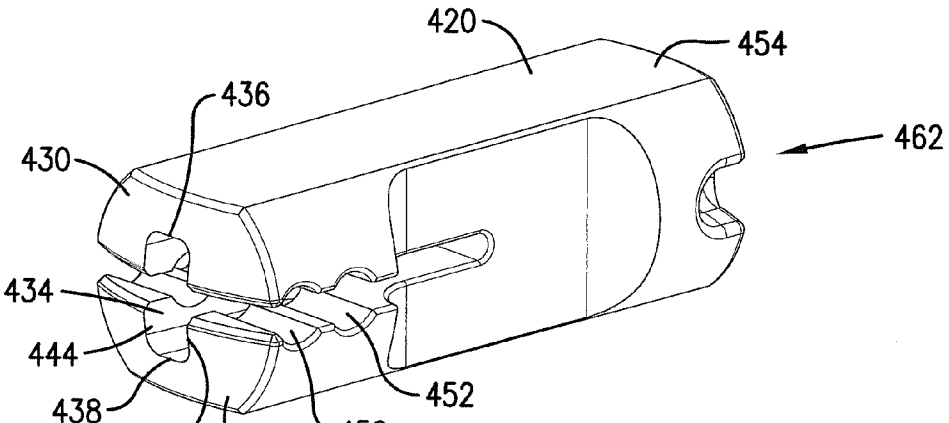
Fig. 21.
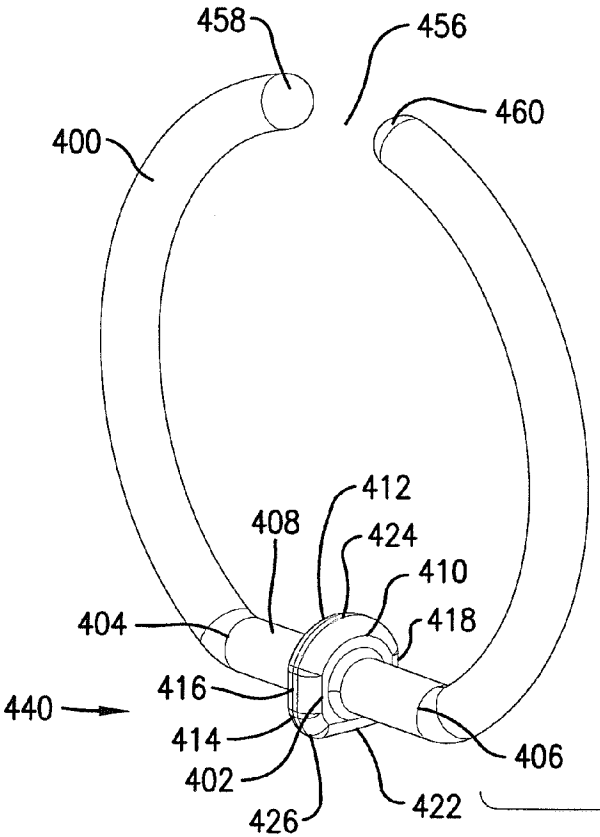

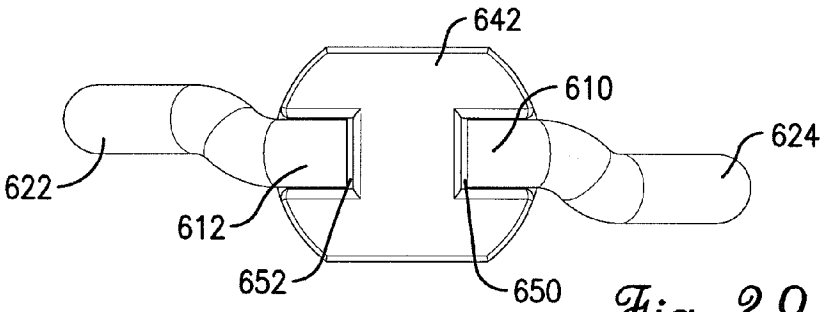
Fig. 29.
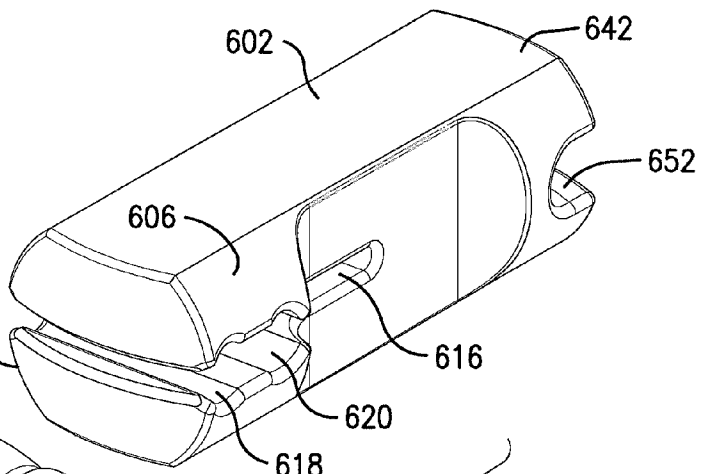
Fig. 28.
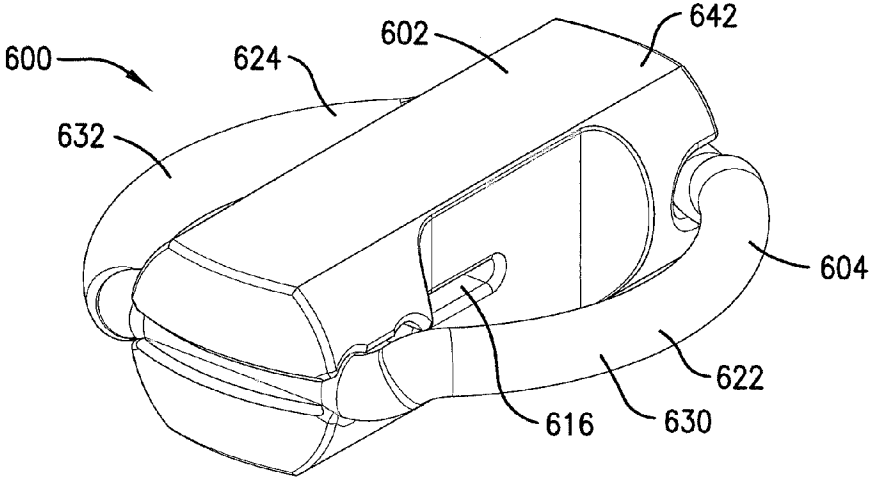
Fig. 27.
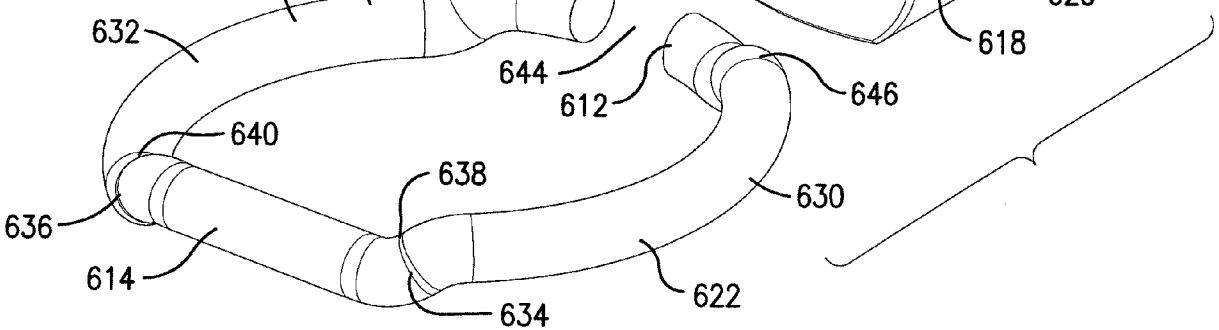

CONNECTION DEVICE FOR HOLDING AN OBJECT, SUCH AS A KEY, DOG TAG, AND THE LIKE

CROSS REFERENCE TO RELATED APPLICATIONS

The present application claims the benefit of and priority from each of the following provisional applications, the entire disclosures of each of which are hereby incorporated by reference herein as if fully set forth herein: U.S. Provisional Patent Application Ser. No. 61/358,757, filed Jun. 25, 2010; U.S. Provisional Patent Application Ser. No. 61/434,693, filed Jan. 20, 2011; and U.S. Provisional Patent Application Ser. No. 61/487,850, filed May 19, 2011.

BACKGROUND OF THE INVENTION

1. Field of the Invention

The present invention relates generally to connection devices. More specifically, the present invention concerns connection devices for holding objects, such as, for instance, keys or dog tags.

2. Discussion of Prior Art

Those ordinarily skilled in the connection device or connector art will appreciate that connectors for holding objects such as keys or dog tags employ a split ring or S-hook configuration which present difficulties when a user adds or removes objects therefrom. For instance, a traditional split ring may be constructed of a single piece of spring metal wire configured in a double loop. The resilient spring metal resiliently urges each of the respective loops against one another such that a user is required to pry open an end of the spring metal to permit a user to add objects thereto by threading the object along the ring. Similarly, to remove an object from a traditional split ring a user must pry open an end of the spring metal and thread the object along the ring until the object is removed. A tool is often necessary to pry open an end of the ring to add or remove objects from a split ring connector.

Likewise, a traditional S-hook connector may be constructed of resilient metal and incorporates two loops configured and shaped like the letter "S". To add or remove an object from a traditional S-hook, a user may use a tool, such as plyers, to pry one of the loop ends open and away from the body of the hook, add or remove the desired objects from the S-hook, and then urge the end of the hook back to its original position.

Thus, a user may experience difficulty in adding or removing objects from conventional connectors like split rings or S-hooks because the effort necessary to open the connector to add or remove objects often requires the use of tools, which may be unwieldy and may not be readily available. Moreover, the effort required to add or remove objects to or from a traditional split ring or S-hook may cause a user to apply too much force and render the connector unsuitable for continued use. For instance, the user may exceed the limits of resiliency of the split ring or S-hook and bend or break the connector such that it is no longer capable of readily retaining objects thereon.

SUMMARY OF THE INVENTION

Responsive to these and other problems, an important object of the present invention is to provide a connection device for holding various types of objects, such as for instance a key, dog tag, and the like.

According to a first aspect of the present invention, the connection device comprises a ring and a body. The ring presents spaced apart ends defining an opening therebetween. The opening is configured and so dimensioned to receive at least a portion of the object therethrough. The body includes a blocking portion operable to substantially close the ring opening so as to restrict removal of the object from the ring. The body is shiftably interconnected with the ring at a hinged connection that is movable between a first position and a second position. In the first position the blocking portion blocks at least a portion of the object from passing through the ring opening. In the second position the ring and body are relatively swingable about the hinged connection location so that the blocking portion may be moved away from the ring to thereby allow access to the opening and removal of the object.

Another aspect of the present invention concerns a connection device comprising a ring and a body. The ring presents spaced apart ends defining an opening therebetween. The opening is configured and so dimensioned to receive at least a portion of the object. The body is swingably interconnected with the ring about a hinged connection so that the body may be swung into and out of a blocking position relative to the opening to thereby prevent removal of the object. The ring further presents a body-engaging ring surface. The body also includes a pair of flexible arms. Each of the flexible arms includes walls engaging the ring surface to cooperatively define the hinged connection. The ring surface presents a plurality of faces. The walls each have a wall face engaging the surface to releasably retain the body and ring in one of a plurality of indexed positions. Relative swinging of the body and ring between the positions cause the arms to yieldably flex.

A further aspect of the invention is to provide a connection device for holding various objects, such as for instance a key, dog tag, and the like. The connection device comprises a ring and a body. The ring presents spaced apart ends defining an opening therebetween. The opening is configured and so dimensioned to receive at least a portion of the object. The body is swingably interconnected with the ring for movement into and out of a blocking position, in which a blocking portion of the body is aligned with the opening and configured to restrict removal of the object from the ring. The ring presents a pair of ring surfaces that face in opposite axial directions and extend substantially radially. The body presents a pair of body surfaces, each of which interengages a respective one of the ring surfaces so that movement of the body along the ring is generally restricted to ensure alignment of the blocking portion with the opening when the body is in the blocking position.

An additional aspect of the invention is to provide a connection device for holding an object, such as a key, dog tag, and the like. The connection device comprises a ring and a body. The ring presents spaced apart ends defining an opening therebetween. The opening is configured and so dimensioned to receive at least a portion of the object therethrough. The body is swingably interconnected with the ring such that it may swing into and out of a blocking position relative to the opening to prevent removal of the object. The body includes a clasp engageable with the ring to releasably lock the body in the blocking position. The clasp includes a shiftable catch that engages the ring when the catch is in a locking position and the body is in blocking position. The clasp includes a biasing element that yieldably biases the catch into the locking position, with shifting of the catch against the bias out of the locking position permits the body to be swung out of the blocking position.

Other aspects and advantages of the present invention will be apparent from the following detailed description of the preferred embodiments and the accompanying drawing figures.

This summary is provided to introduce a selection of concepts in a simplified form that are further described below in the detailed description of the preferred embodiments. This summary is not intended to identify key features or essential features of the claimed subject matter, nor is it intended to be used to limit the scope of the claimed subject matter.

BRIEF DESCRIPTION OF THE DRAWING FIGURES

Preferred embodiments of the invention are described in detail below with reference to the attached drawing figures, wherein:

FIG. 20 is perspective view of a fourth embodiment of the connection device;

FIG. 21 is an exploded view of the connection device depicted in FIG. 20;

FIG. 27 is a perspective view of a sixth embodiment of the connection device;

FIG. 28 is an exploded view of the connection device depicted in FIG. 27;

FIG. 29 is an end elevation view of the connection device depicted in FIGS. 27 and 28, particularly showing the aligned ring ends and the blocking portion of the body spanning the ring opening;

Figure 34:
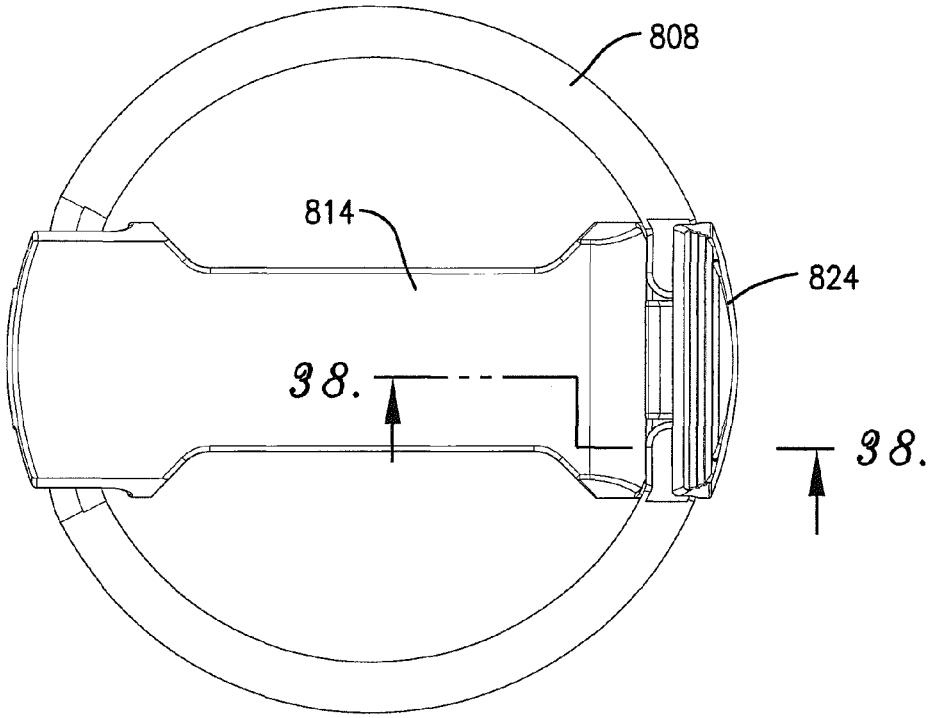
FIG. 34 is a top plan view of the connection device depicted in FIGS. 32 and 33.
Figure 37:
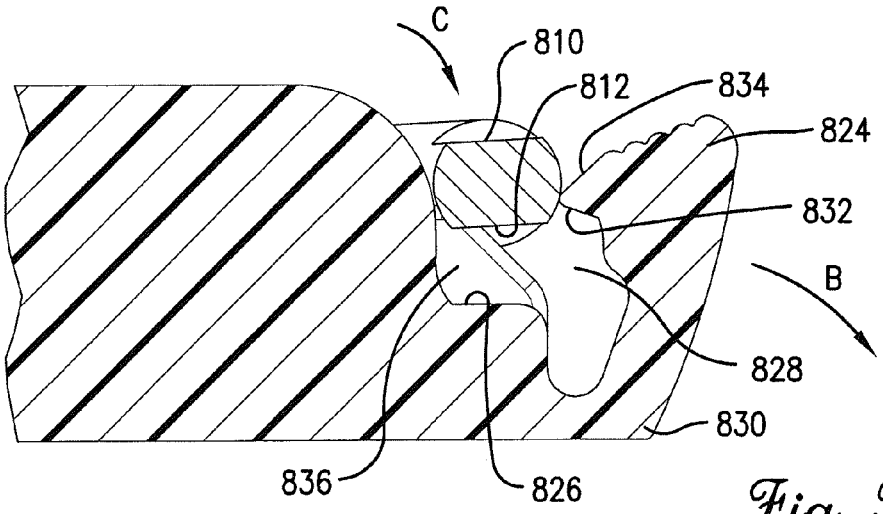
Figure 38:
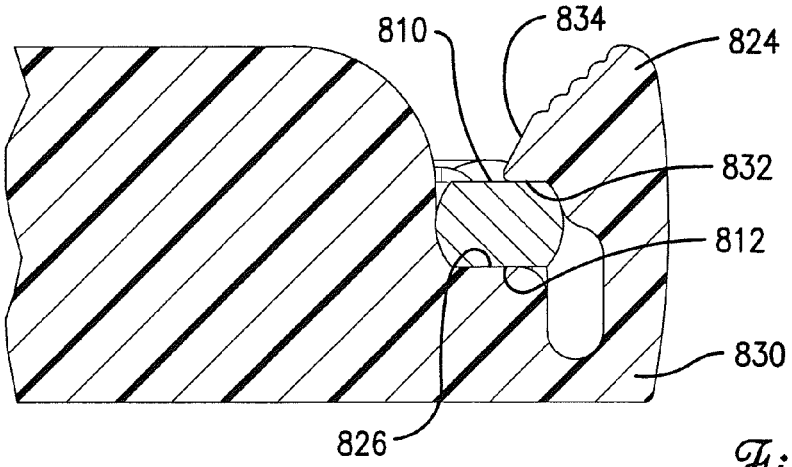

FIG. 37 is an enlarged fragmentary cross-sectional view of the connection device taken along line 38-38 of FIG. 34, but showing the catch shifted out of the locking position against the bias of the biasing element as the body is placed in the blocking position; and FIG. 38 is an enlarged fragmentary cross-sectional view of the connection device taken along line 38-38 of FIG. 34, but showing the body in the blocking position and the catch in the locking position.

The drawing figures do not limit the present invention to the specific embodiments disclosed and described herein. The drawings are not necessarily to scale, emphasis instead being placed upon clearly illustrating the principles of the preferred embodiments.

DETAILED DESCRIPTION OF THE PREFERRED EMBODIMENTS

Figure 1:
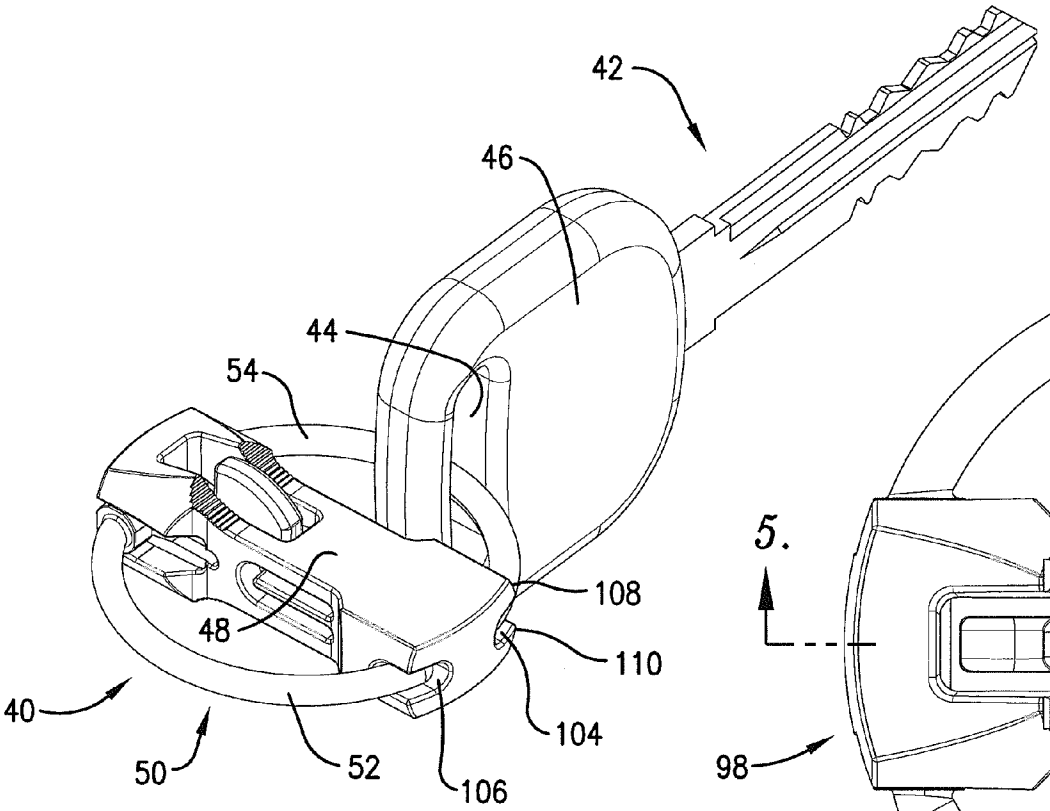
FIG. 1 is a top perspective view of a connection device constructed in accordance with the principles of a principal preferred embodiment of the present invention, with the connection device being depicted in use with a key to thereby serve as a key ring.

With reference to the drawings, wherein like reference numerals designate like parts and assemblies throughout the several views, FIG. 1 shows the preferred embodiment of a connection device 40, also referred to herein as a connector, for holding objects. The connector 40 may hold various types of objects such as, for instance, keys, dog tags, or the like. The connector 40 shown in FIG. 1 is in a closed position in which a key 42 is retained thereon. The key 42 is of a traditional type which contains at least a through-hole 44 in the base 46 of the key 42. The through-hole 44 is configured to receive the ring 50 therein to operatively interconnect the connector 40 and key 42 together.

The connector 40 broadly includes a body 48 and a ring 50. The body 48 preferably bisects the ring 50 into two arcuate ring portions 52,54. While the embodiments of the connector 40 shown herein involve a body 48 that bisects the ring 50, alternative embodiments of the connector 40 may only include a single ring portion 52 extending from the body 48. In the disclosed embodiments, however, each respective ring portion 52,54 is capable of retaining a plurality of objects thereon. Although the connector 40 depicted in FIG. 1 is shown retaining a key 42 thereon, it is understood that embodiments of the connector 40 may be of various sizes to meet the required needs of holding various sized and dimensioned objects.

Figure 2:
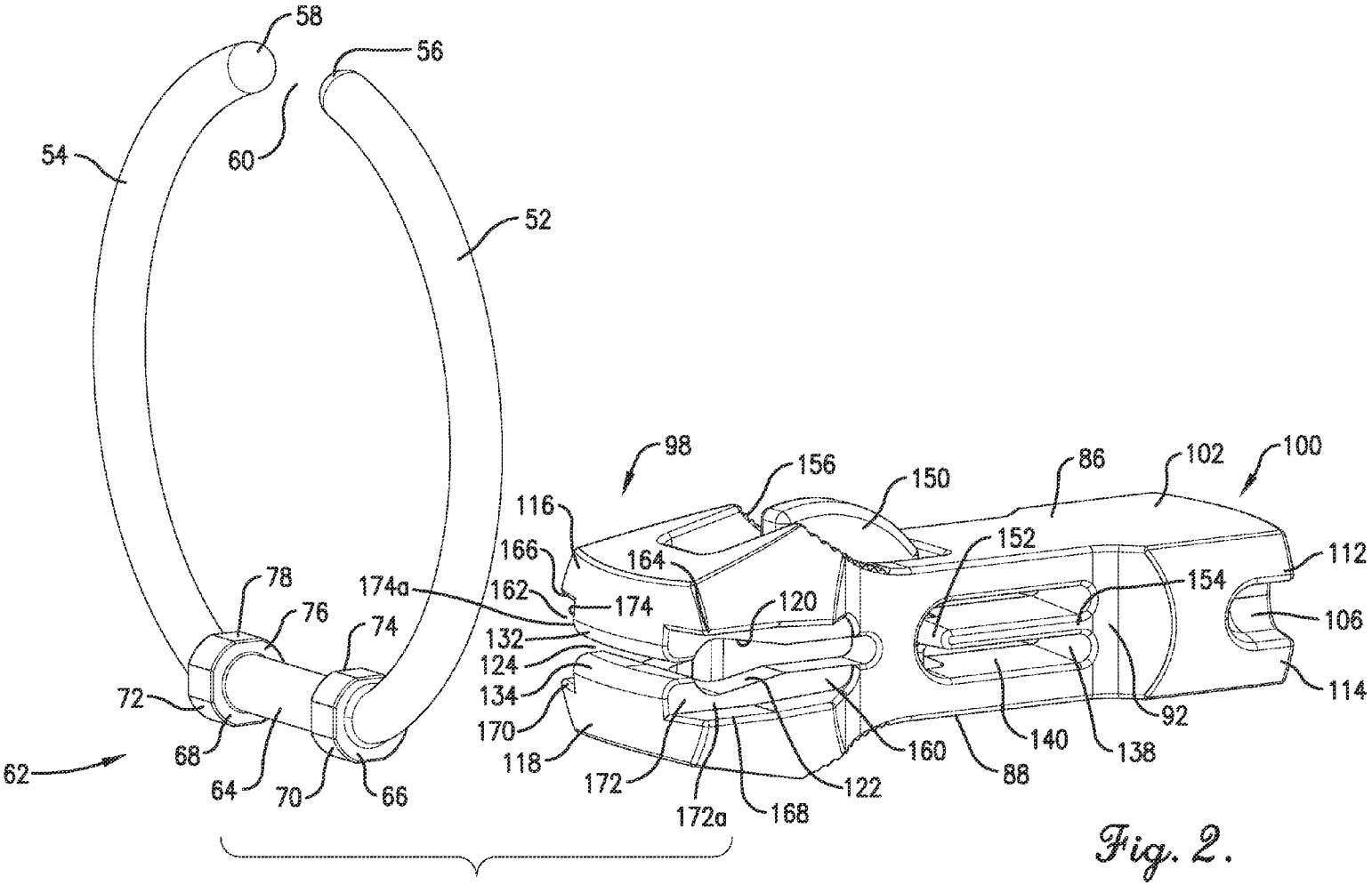
FIG. 2 is an exploded view of the connection device shown in FIG. 1.

FIG. 2 separately depicts the ring 50 and body 48 of the connector 40. Referring first to the ring 50, the ring 50 is preferably constructed of a lightweight material generally capable of retaining its shape and form when in use. Preferably, the ring 50 is metal and capable of being formed by a process of injection molding. However, other suitable materials and fabrication techniques can be used to make the ring 50 without departing from the spirit of the present invention. For example, the ring 50 could alternatively be machined or cast of metal or a composite material. The ring 50 is preferably substantially toroidal in shape but may optionally be configured in any shape such as, for instance, a dog bone or an animal character. Likewise, although the arcuate ring portions 52,54 of the ring 50 are shown to be generally cylindrically shaped along their axis, the ring 50 may be of any shape capable of retaining an object thereon. For example, the ring portions 52,54 may alternatively have a polygonal cross-sectional shape.

The ring 50 is shown presenting arcuate ring portions 52,54 terminating in respective spaced apart ends 56,58. The ends 56,58 of the ring 50 define an opening 60 therebetween that is sized and dimensioned to accommodate addition and removal of various objects sought to be retained on the connector 40. As will be described in further detail herein, the opening 60 operatively provides access to the connector 40 by permitting objects to be received onto either respective ring portion 52,54 when the connector 40 is in an open state. Conversely, when an object retained on the connector 40 is to be removed, the object will be removed through the opening 60 defined by the ring ends 56,58.

The ends 56,58 of the ring 50 are preferably semispherically shaped to facilitate adding objects to the connector 40. In this manner the semispherically shaped ends 56,58 of the ring 50 are more resistant to being snagged or caught on objects being added to the connector 40 because the ends 56,58 present a substantially smooth dome shape more aptly configured to receive objects onto the ring portions 52,54. It is understood, however, that the ends 56,58 may be of any shape or form.

Still referring to FIG. 2, the ring 50 presents a hinge end 62 about which the ring 50 of the connector 40 may be swung when in operation. Although the hinge end 62 is preferably opposite the opening 60 of the ring 50, the hinge end 62 may be located elsewhere along the ring 50. The hinge end 62 includes a hinge portion 64 located between respective ring portions 52,54. The hinge portion 64 is bounded on both sides by respective projections 66,68. The projections 66,68 are preferably continuous and extend endlessly about the entire circumference of the ring 50. The hinge portion 64 is depicted herein as being integrally formed as part of the ring 50, but other constructions may suitably meet the objects of the present invention, such as, for instance, a non-integral hinge portion 64. The hinge portion 64 has a diameter that is preferably larger than the diameter of the respective arcuate ring portions 52,54 of the ring 50. In addition, while the hinge portion 64 is preferably substantially straight, the hinge portion 64 may alternatively be non-linear and still embody the principles of the preferred embodiments herein.

In the illustrated embodiment, each of the ring projections 66,68 is located at an end of the hinge portion 64 and between the hinge portion 64 and the corresponding arcuate ring portion. However, the projections 66,68 may be alternatively situated without departing from the scope of the present invention. The ring projections 66,68 each present a circumferential indexing surface 70,72 and opposite radially extending alignment surfaces 74,76. The indexing surface 70,72 of each of the projections 66,68 may be smooth around their respective circumferences, but is preferably faceted and capable of presenting a plurality of faces 78. Each of the faces 78 of the indexing surfaces 70,72 preferably circumferentially aligned with each of the respective faces 78 of the other indexing surfaces 70,72. Each flat face is preferably diametrically opposed to another flat face so that they can simultaneously engage the body 48 as further described herein. In addition, faces 78 of the indexing surface preferably alternate among substantially flat portions 82 and substantially arcuate portions 84. Other embodiments of the connector 40 may, however, have indexing surfaces 70,72 without alternating faces. In addition, other embodiments of the connector 40 may not include the indexing surfaces 70,72 on the respective projections 66,68. As will be described in further detail herein, the faces 78 of each indexing surface 70,72 cooperate with other structure to provide indexing capabilities to maintain various positions of the ring 50 and body 48 when the connector 40 is open and the ring 50 and body 48 are relatively swung.

Still referring to the ring 50 shown in FIG. 2, the alignment surfaces 74,76 of the projections 66,68 are preferably oppositely facing and preferably substantially perpendicular to the circumferential surface of the ring 50. However, the alignment surfaces 74,76 are not required to be perpendicular to the circumferential surface of the ring 50. Rather, any radial component relative to the ring 50 axis may suffice to provide respective alignment surface 74,76. The space between the projections 66,68 is so dimensioned to receive therebetween at least a portion of the body 48. As discussed in further detail herein, the alignment surfaces 74,76 cooperate with the body 48 to prevent relative sliding of the body 48 along the axis of the ring 50. In this manner yaw misalignment of the ring 50 and body 48 is minimized such that the body 48 of the ring 50 is maintained in cooperative alignment with the ring opening 60 to facilitate operation of the connector 40.

Referring now to the body 48 shown in FIG. 2, the body 48 is preferably constructed of a lightweight material (e.g. metal) having sufficient resiliency to operate in the manner described herein. More particularly, the body 48 is formed of a synthetic resin material such as plastic. More preferably, the body 48 is integrally formed of an injection molding process. The illustrated body 48 generally has a top 86, bottom 88, respective sides 90,92, and two ends 94,96, each of which has a respective outer surface. One end 94 of the body 48 forms a hinge end 98 and the other end 96 forms a blocking end 100.

The blocking end 100 of the body 48 presents a blocking portion 102. The blocking portion 102 is dimensioned so as to substantially span the ring opening 60 when the connector 40 is in the closed position. Additionally, the blocking portion 102 includes a pair of recesses 104,106 on respective sides 90,92 of the blocking portion 102 of the body 48. The recesses 104,106 are sized and configured to receive respective ends 56,58 of the ring 50 when the connector 40 is in the closed position. The recesses 104,106 are preferably aligned opposite each other on opposing sides 90,92 of the blocking portion 102 of the body 48. Further, the blocking portion 102 preferably includes a pair of chamfers 108,110 and another pair of chamfers 112,114 located at the outer surface of the blocking portion 102 adjacent the respective recesses 104, 106. The recess chamfers 108,110,112,114 guide the respective ring ends 56,58 into the recesses 104,106 when the ring 50 and body 48 are relatively swung into the closed position.

Figure 4:
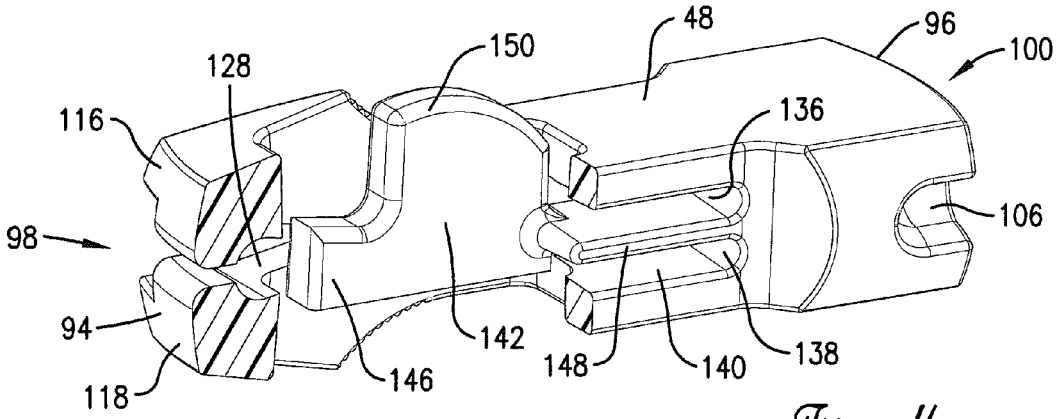
FIG. 4 is an enlarged partially sectioned perspective view of a body of the connection device.
Figure 5:
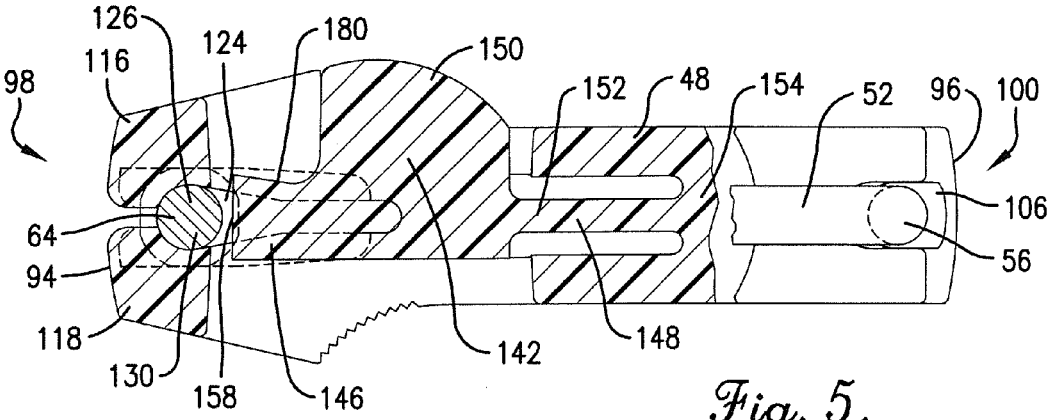
FIG. 5 is a partial cross-sectional view of the connection device taken along line 5-5 of FIG. 3, particularly depicting the hinged connection locked in a first position.
Figure 6:
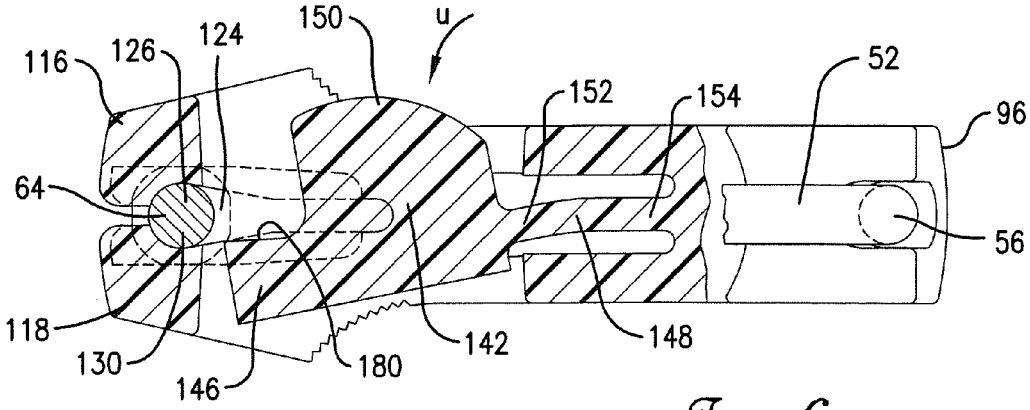
FIG. 6 is a partial cross-sectional view of the connection device similar to FIG. 5, but showing a lock member of the locking mechanism shifted out of the locked position.

Referring now to FIGS. 2 and 5, the hinge end 98 of the body 48 has two arms 116,118 that are preferably integrally formed as part of the body 48. The arms 116,118 present opposing walls 120,122 that cooperatively define a slot 124 therebetween. The slot 124 is configured to receive the hinge portion 64 of the ring 50, with the hinge portion 64 and arms 116,118 cooperatively forming a hinged connection 126 between the body 48 and ring 50. It is also noted that the slot 124 is configured so that the hinge portion 64 of the ring 50 is moveable therein, thereby permitting the hinged connection 126 to shift. As shown in FIGS. 4 and 5, a receiving area 128 is preferably formed adjacent one end of the slot 124 to receive the hinge portion 64 of the ring 50 at a first location corresponding to a first position 130 of the hinged connection 126. As will be described, this position of the hinged connection 126 corresponds with the closed condition of the connector 40 (assuming the ring ends 56,58 have been aligned with the recesses 104,106). In the preferred embodiment, the arms 116,118 of the walls 120,122 are resiliently flexed (which is enhanced by the relatively enlarged diameter of the hinge portion 64), which urges the hinge portion 64 to remain in the receiving area 128. Further, the slot 124 preferably tapers as a result of the walls 120,122 of the arms 116,118 converging away from the receiving area 128. The tapered slot 124 cooperates with the urging action provided by the flexed walls 120,122 to guide the hinge portion 64 into the receiving area 128.

As shown in FIGS. 2, 4 and 5, the slot 124 is preferably open-ended, but other embodiments may include a body 48 having a closed-ended slot 124. The arms 116,118 preferably present opposing shoulders 132,134 that substantially enclose the end of the slot 124 defined at the hinge end 98 to restrict the hinge portion 64 of the ring 50 from being urged out of the slot 124 when the connector 40 is in operation. As shown, interior portions of the shoulders 132,134 cooperate to form the receiving area 128 for the hinged connection 126.

The opposite end of the slot 124 communicates with a cavity 136 defined by a plurality of interior body walls 138, 140 within the body 48. In the illustrated embodiment, the body 48 is provided with a locking mechanism 142 for locking the hinged connection 126 in the first position 130. As will be described, the locking mechanism 142 serves to secure the connector 40 in the closed condition so that an inadvertent removal of the objects from the ring 50 is prevented. Furthermore, a locking mechanism 142 is not required with respect to certain aspects of the present invention. At least a portion of the locking mechanism 142 is located within the cavity 136. The cavity 136 communicates with an opening 144 in the body 48 to provide the locking mechanism 142 sufficient volume in which to operate. Although the cavity 136 described herein is not entirely enclosed, alternative embodiments of the connector 40 may include a lock mechanism that is fully enclosed within the body 48.

The preferred locking mechanism 142 generally includes a lock member 146 configured to engage the hinge portion 64 of the ring 50, a bias member 148 yieldably biasing the lock member 146 into a locked position, and an actuator 150 for providing manual operation of the locking mechanism 142. FIG. 5 shows the relationship of the components of the locking mechanism 142, the body 48, and the hinge portion 64 of the ring 50. Preferably, the locking mechanism 142 is integrally formed as part of the body 48. Turning first to the biased positioning of the lock member 146, the illustrated bias member 148 projects from one of the internal walls 138,140 to define a cantilevered spring arrangement. A cantilevered end 152 of the bias member 148 carries the lock member 146. Again, the other end of the bias member 148 is preferably supported by one of the interior walls 138,140 of the body 48. The resiliency of the cantilevered bias member 148 maintains the lock member 146 in the locked position, with flexing of the bias member 148 permitting the lock member 146 to shift out of the locked position. While preferred embodiments of the connector 40 described herein preferably use a cantilevered spring, those of skill in the art will readily recognize that numerous other devices, such as mechanical springs, electro-mechanical switches, or magnetic devices may be suitably employed to provide a biasing action for use in the locking mechanism 142.

Figure 3:
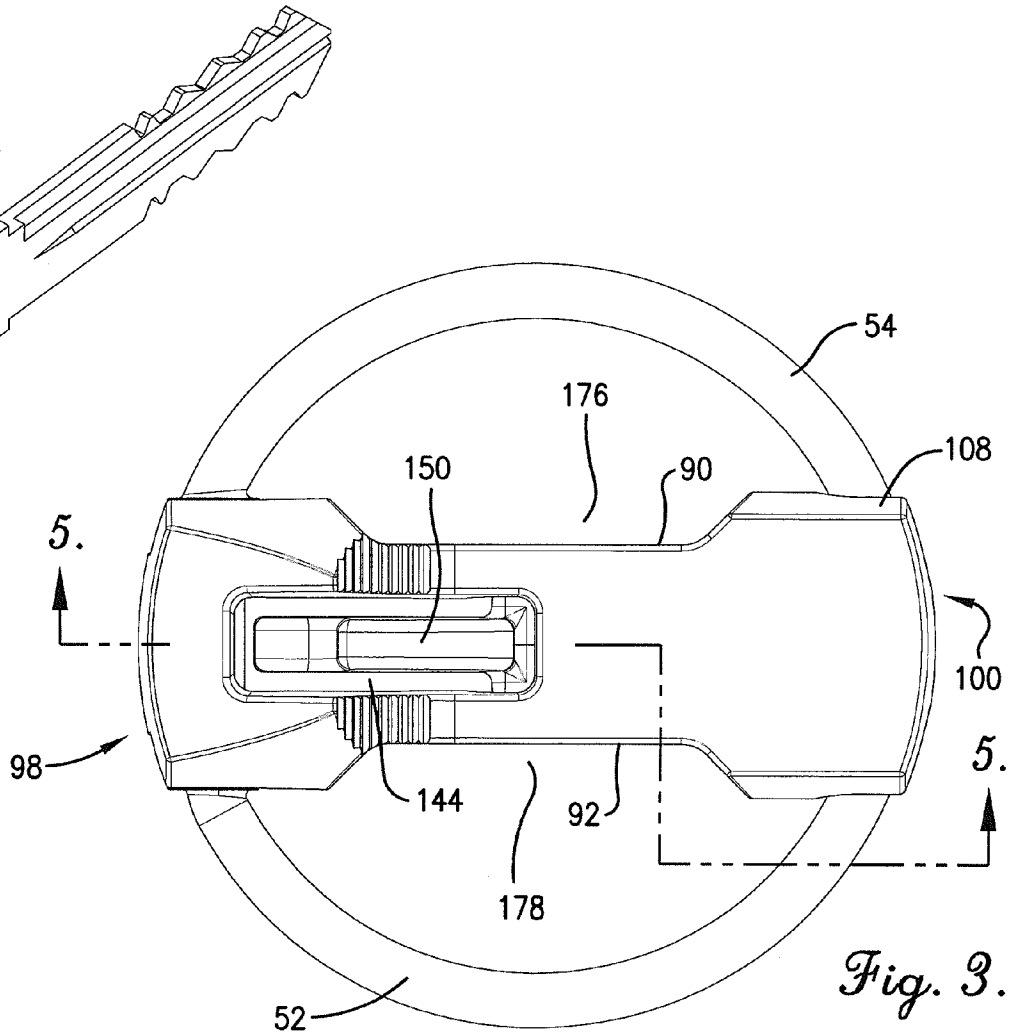
FIG. 3 is a top plan view of the connection device.

The actuator 150 preferably projects above the top surface 86 of the body 48 through an opening 144 in the body 48, which is more clearly shown in FIGS. 2 and 4, such that a user may more easily access the actuator 150 to disengage the locking mechanism 142. The actuator 150 projects from the bias member 148 at a location spaced from the supported end 154. Therefore, when the actuator 150 is pushed by a user, the bias member 148 and the lock member 146 are shifted, causing resilient flexing of the bias member 148. It is understood, however, that the actuator 150 may operably be located elsewhere on the body 48 or be otherwise alternatively configured. As shown in FIGS. 2 and 3, at least a portion of the top surface 86 preferably includes a sloped face 156 adjacent the actuator 150. The sloped face 156 is preferably shaped to act as a stop so that when the actuator 150 is depressed by a user the actuator 150 will not be overly depressed and risk potentially damaging the locking mechanism 142. Furthermore, the sloped face 156 is preferably corrugated so that when a user depresses the actuator 150, the user's finger will not unintentionally slip off the sloped face 156 causing the locking mechanism 142 to be re-engaged. One of skill in the art will readily observe that the corrugations of the sloped face 156 may be replaced with any structure suitable to accomplish its purpose, such as, for instance, stippling or roughing of the sloped surface.

FIGS. 4 and 5 both show the lock member 146 in a locked position, wherein the lock member 146 is positioned in the slot 124 in a blocking relationship with the hinge portion 64. Notably the lock member 146 includes a tip 158. The tip 158 of the lock member 146 is configured to engage the hinge portion 64 if the hinge portion 64 is urged along the slot 124 away from the open end. In this manner, the lock member 146 is configured to selectively prevent the hinge portion 64 from moving out of the first location within the receiving area 128 of the slot 124. As depicted in FIG. 5, when the hinge portion 64 is in the first location and the ends 56,58 of the ring 50 are secured by respective recesses 104,106 at the blocking end 100 of the body 48, the lock member 146, which is retained by the bias member 148 in the locked position, prevents inadvertent opening of the connector 40. However, the actuator 150 may be manually pressed to shift the lock member 146 against the bias of the bias member 148 sufficiently out of the locked position to permit the hinge portion 64 of the ring 50 to move along the slot 124 out of the first location (e.g. see FIG. 7).

Referring again to FIG. 2, the arms 116,118 further include oppositely facing channels 160,162 located along their side surfaces 90,92 adjacent to the slot 124. Each of the channels 160,162 has upper channel walls 164,166 and lower channel walls 168,170 running at least a portion of the length of the slot 124. The channels 160,162 further include outwardly facing interior channel walls 172,174. The upper 164,166, lower 168,70, and interior 172,174 channel walls are each preferably at least partially planar and flat. Preferably, the upper wall 164 and lower wall 168 converge away from the receiving area 128, thereby providing a taper to the channel, which further enhances urging of the hinged connection 126 to the first position 130. As will be described in further detail herein, respective ring projections 66,68 are received within the channels 160,162 to provide indexing capabilities and ring alignment capabilities.

The structure exemplifying the preferred embodiment of the connector 40 is assembled by uniting the above-described ring 50 and body 48. It is understood that assembly of the ring 50 and body 48 is presented only in the interest of completeness in describing the principal embodiment of the present invention. However, the scope of the present invention shall not be limited by preferred assembly techniques as described herein. To that end, to assemble the preferred embodiment of the invention, the hinge portion 64 of the ring 50 is mateably engaged with the hinge end 98 of the body 48. Notably, the hinge portion 64 of the ring 50 is inserted into slot 124 by first passing the hinge portion 64 through the open-ended slot 124 and past the shoulders 132,134 of the arms 116,118. The arms 116,118 preferably and operatively present a resilient flexing force toward one another and thus urge the shoulders 132,134 toward one another such that the hinge portion 64 must be urged past the shoulders 132,134 and into the slot 124 with an appreciable force. Once the resilient flexing force of the arms 116,118 is overcome, the hinge portion 64 of the ring 50 passes the shoulders 132,134 and is seated within the slot 124 at the receiving area 128 and ready for further use as described herein. Preferably, the diameter of the hinge portion 64 is dimensioned to be slightly larger than the complementally sized slot 124 such that the arms 116,118 are flexed and present a flexing force upon the hinge portion 64 to thereby grip the hinge portion 64 within the slot 124.

Once mateably engaged, the ring projections 66,68 are complementally seated within respective channels 160,162 of the body 48. The ring projections 66,68 are dimensioned and configured so as to snugly fit the indexing surfaces 70,72 with the upper channel walls 164,166 and lower channel walls 168,170 within the respective channels 160,162. The snug fit assists with indexing the body 48 and ring 50 into a plurality of positions as further described herein.

Further exemplifying the preferred embodiment of the connector 40, the interior walls 172,174 of the channels 160, 162 present oppositely facing body surfaces 172*a*,174*a* that cooperatively interengage with the ring alignment surfaces 74,76 when the connector 40 is assembled (see FIG. 2). In particular, the interengagement of the ring alignment surfaces 74,76 with the body surfaces 172*a*,174*a* of the interior channel walls 172,174 prohibits yaw misalignment of the blocking portion 102 when the connector 40 is in use. More particularly, the ring alignment surfaces 74,76 interengage with the interior channel walls 172,174 to restrict the body 48 from slidably moving along the axis of ring 50. If the body 48 were to slide along the ring 50 when the connector 40 was in use, a user may not be able to properly close the connector 40 because the ring 50 and body 48 may not properly swing into a position in which the blocking portion 102 blocks at least a portion of the opening 60 of the ring 50. Furthermore, yaw misalignment between the ring 50 and body 48 might also prevent the ring ends 56,58 from properly resting within the recesses 104,106. It is understood that the interengagement between the ring alignment surfaces 74,76 and the interior channel walls 172,174 need not necessarily be snug to accomplish satisfactory alignment of the blocking portion 102. Rather, some leeway may exist between one channel interior wall 172 and its respective ring alignment surface 74 or both interior walls 172,174 and their respective ring alignment surfaces 74,76. The alignment feature herein described may be accomplished in numerous different ways, some of which will be discussed in further detail herein.

As perhaps best shown in FIG. 3, the sides 90,92 of the body 48 are inwardly tapered to present respective body indentations 176,178 along at least a portion of the length of the respective side 90,92 surfaces. The indentations 176,178 serve at least two notable functions. First, the indentations 176,178 facilitate the connector's 40 ability to retain larger objects on respective ring portions 52,54 of the connector 40. Second, the indentations 176,178 allow objects retained on respective arcuate ring portions 52,54 of the connector 40 to have increased freedom to slide and move on the ring portions 52,54, thereby facilitating use of the connector 40 and access to any one of a plurality of objects retained thereon. The indentations 176,178 are preferably formed on both side surfaces 90,92 of the body 48. It is understood, however, that only one side 90 surface of the body 48 may include an indentation 176.

As previously noted, when the connector 40 is closed the ring ends 56,58 are complementally received into respective recesses 104,106 of the blocking portion 102 of the body 48 (see FIG. 3).

As depicted in FIG. 3 the end surfaces 94,96 of the hinge end 98 and the blocking end 100 are arcuate, preferably with a similar radius of curvature as the peripheral contour of the arcuate ring portions 52,54. Therefore, when closed, the connector 40 has a more uniform shape, which users thereof may find more visually pleasing and less apt to snag or catch other objects adjacent to the connector 40. It is understood that the end surfaces 94,96 of the body 48 may take any shape to conform to the contour of the ring 50, or may be configured not to conform to the ring 50 at all.

In use, when it is desired to open the connector 40 (so that objects may be removed from or placed on one of the arcuate ring portions 52,54), the user of the connector 40 applies a force along the line u to unlock the connector 40. More particularly, the actuator 150 communicates the applied force to the lock member 146 and bias member 148. As the force is applied along the line u, the actuator 150 shifts within the opening 144 and causes the bias member 148 to resiliently flex downwardly within the cavity 136. As the bias member 148 flexes, the lock member 146 is moved out of the slot 124 to no longer be in a blocking relationship with the hinge portion 64 of the ring 50. This represents the unlocked state of the connector 40.

The lock member 146 presents a top surface 180. As shown, when the connector 40 is in the unlocked state the top surface 180 of the lock member 146 is located at least partially below the slot 124, thus providing the hinge portion 64 of the ring 50 an open path along the slot 124 to moveably shift.

However, as previously described, the arms 116,118 of the walls 120,122 are flexed, which urges the hinge portion 64 to remain in the receiving area 128. The taper of the slot 124 also helps in releasably retaining the hinge portion 64 into the receiving area 128. As the hinge portion 64 moves away from the open end, the arms 116,118 are required to progressively separate and thereby flex (which is further enhanced by the taper) so that the return force exerted by the arms 116,118 progressively increases as the hinge portion 64 moves away from the first location. Thus, notwithstanding disengagement of the locking mechanism 142 such that the connector 40 is in the unlocked state, the preferred embodiment of the connector 40 requires the application of a force to the hinge portion 64 to overcome the yieldable bias causing the hinge portion 64 to remain in the receiving area 128.

If the connector 40 is in the unlocked state and the hinge portion 64 remains in the receiving area 128, and a user ceases applying a force along the line u to unlock the connector 40, the resiliency of the bias member 148 will cause the locking mechanism 142 to return to the locked condition shown in FIG. 5. In this manner, the user of the connector 40 preferably need not actively lock the connector 40 because the locking mechanism 142 automatically returns to the locked position when the actuator 150 is not depressed.

Figure 7:
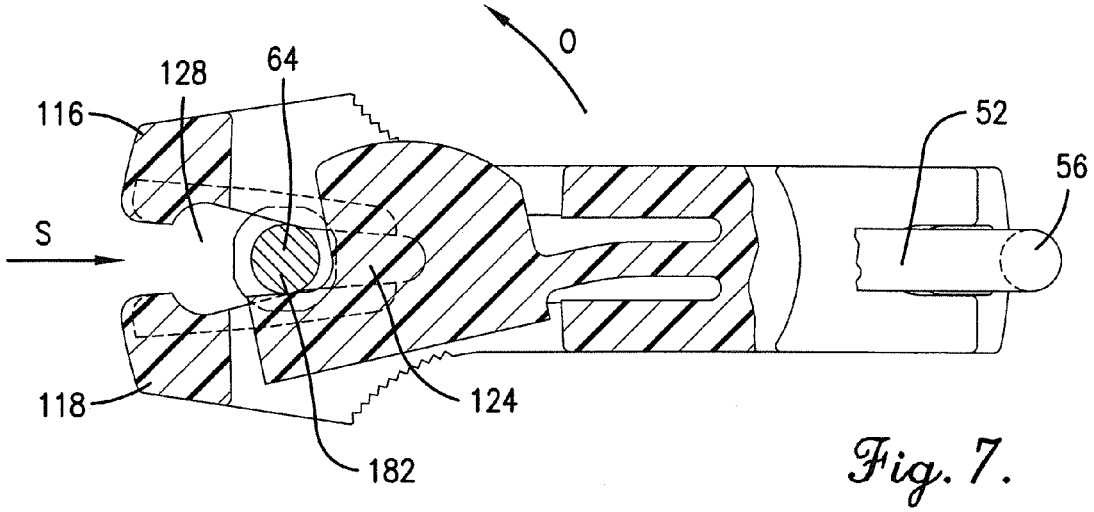
FIG. 7 is a partial cross-sectional view of the connection device similar to FIG. 6, but showing the hinged connection moved to a second position.

On the other hand, with the actuator 150 depressed, the hinge portion 64 may be moved along the slot 124 out of the receiving area 128 (see FIG. 7). Notably, as a force along the line s is applied to the hinge portion 64 of the ring 50 when the connector 40 is in the unlocked state, the hinge portion 64 may move along the slot 124 away from the receiving area 128. The force along the line s is operatively sufficient to overcome the previously described resilient flexing force of the arms 116,118 urging the hinge portion 64 into the receiving area 128. As the hinge portion 64 moves along the slot 124, it is located adjacent the top 180 of the lock member 146. As perhaps best depicted in FIGS. 4 and 5, the top 180 of the lock member 146 is preferably sloped so that engagement of the top 180 of the lock member 146 with the hinge portion 64 will not inadvertently cause the lock member 146 to prevent movement of the hinge portion 64 toward the receiving area 128 as a result of the biasing action of the bias member 148. In addition, the slope of the top 180 of the lock member 146 cooperates with the tapers on the walls 120,122 of the arms 116,118, as well as the urging force of the flexed walls 120, 122, to ensure the hinge portion 64 is resiliently returned to the receiving area 128 when the actuator 150 is no longer depressed and the force along the line s is no longer applied.

Still referring to FIG. 7, with the hinge portion 64 out of the receiving area 128 and moved along the slot 124 to a second position 182 of the hinged connection 126, the respective ring ends 56,58 are coordinately moved out of respective recesses 104,106 of the blocking portion 102. However, if desired, the ring 50 and body 48 may be configured so that the ring ends 56,58 are slightly retained in the recesses 104,106 when the hinged connection 126 is in the second position 182, thereby requiring a force to yieldably deflect the ring ends 56,58 and/or blocking portion 102 of the body 48 as the ring 50 and body 48 are relatively swung out of the position shown in FIG. 7. With this configuration, a force must be applied along the line o of FIG. 8 to "pop" the ring ends 56,58 from the body 48, which consequently frees the ring 50 and body 48 to swing about the hinged connection 126. In this manner, the ring 50 and body 48 may be relatively swung so that the connector 40 is in an open state to permit addition and/or removal of objects because the blocking portion 102 no longer spans the ring opening 60.

Figure 8:
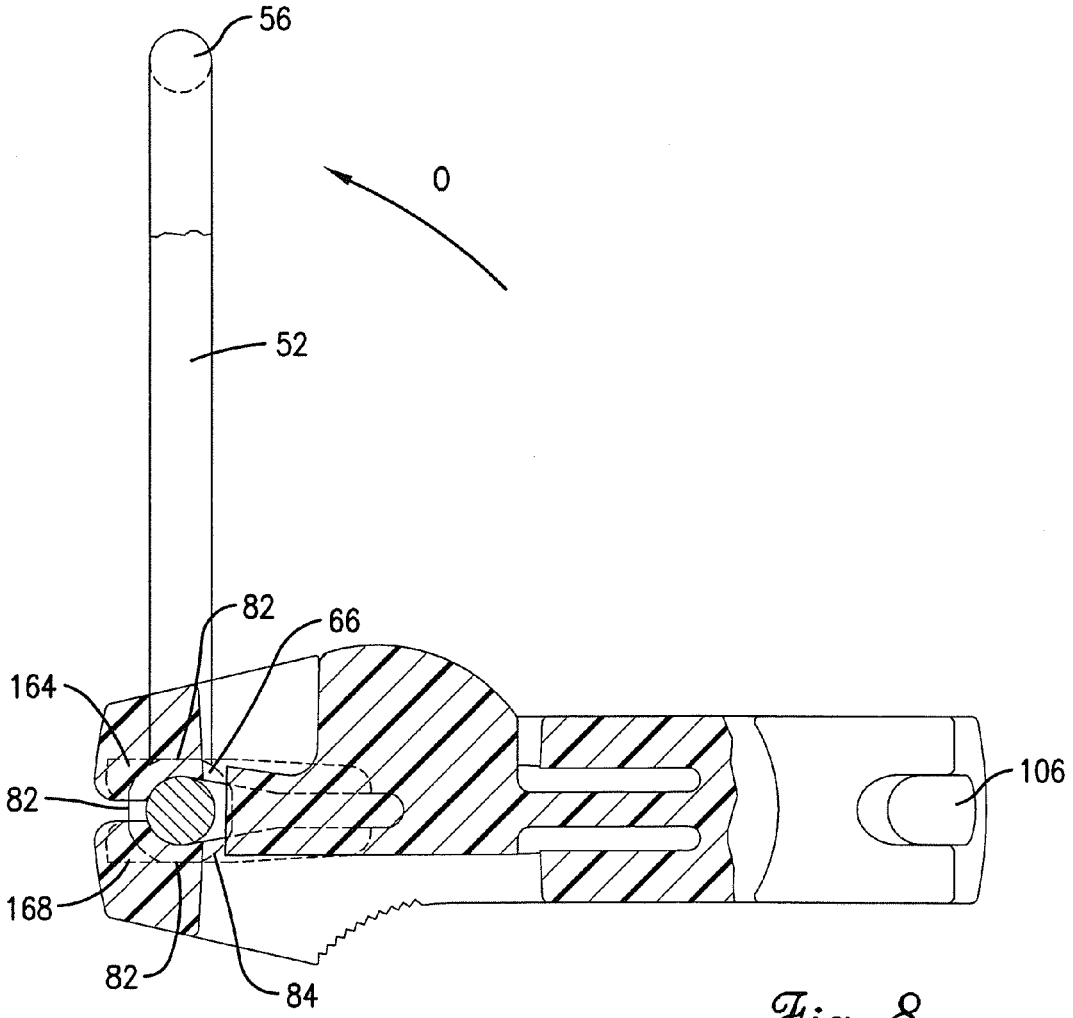
FIG. 8 is a partial cross-sectional view of the connection device similar to FIG. 7, but showing the ring and body relatively swung so that the ring opening is spaced from the blocking portion of the body.
Figure 9:
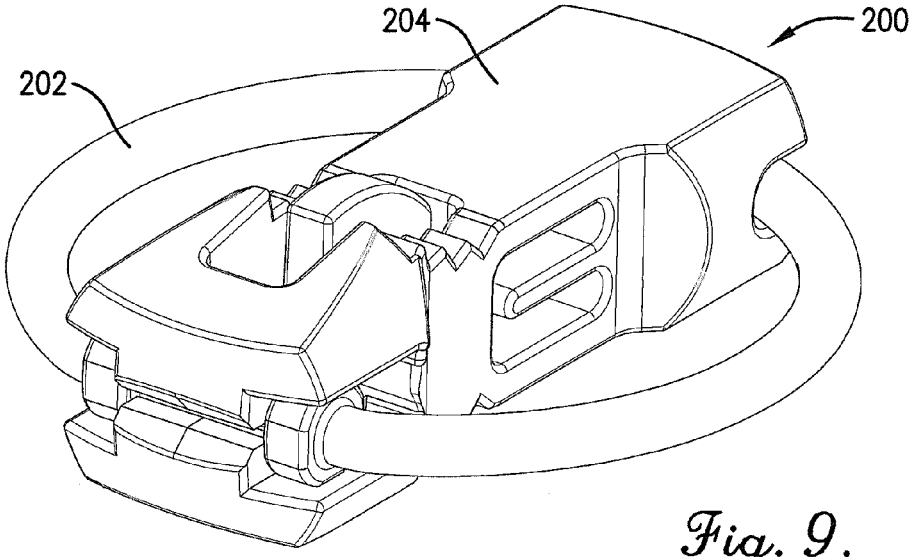
FIG. 9 is a top perspective view of a second embodiment of the connection device.
Figure 10:
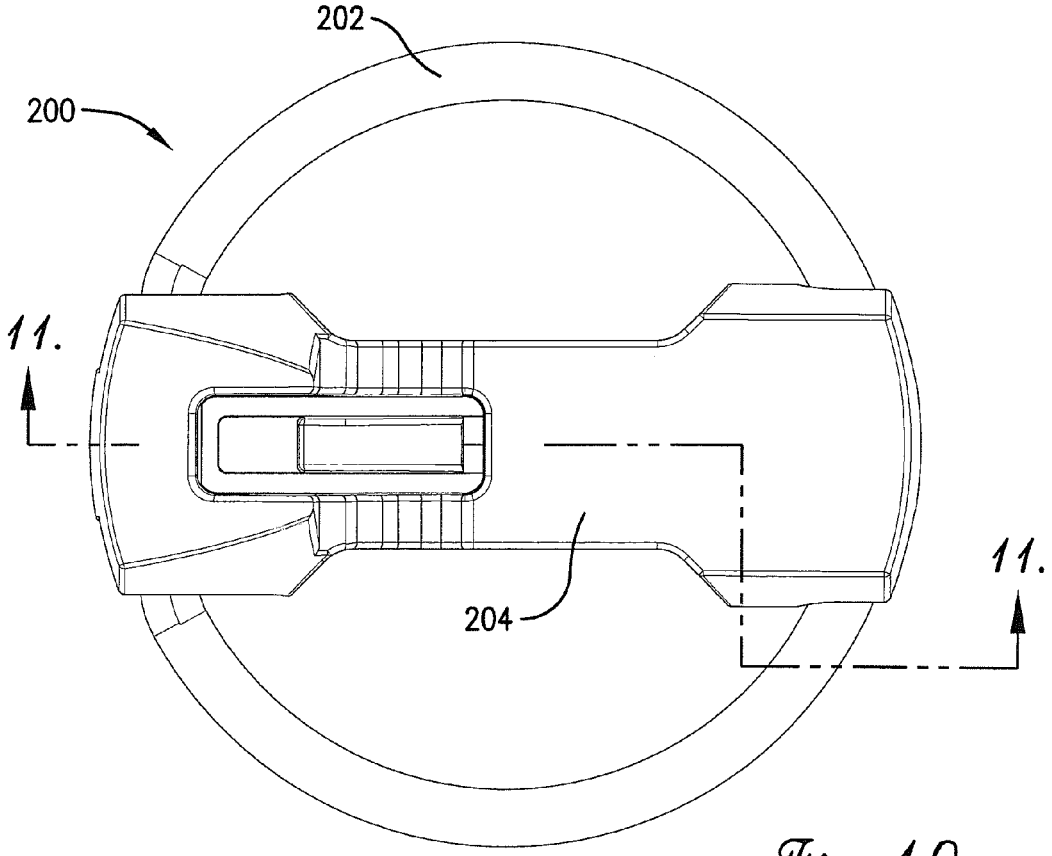
FIG. 10 is a top plan view of the connection device depicted in FIG. 9.
Figure 11:
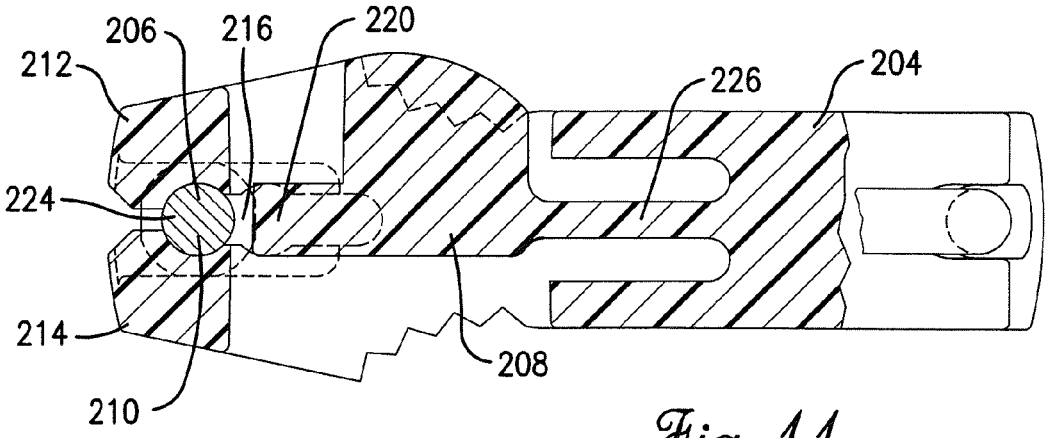
FIG. 11 is a partial cross-sectional view of the connection device taken along line 11-11 of FIG. 10, particularly depicting the hinged connection locked in a first position.
Figure 12:
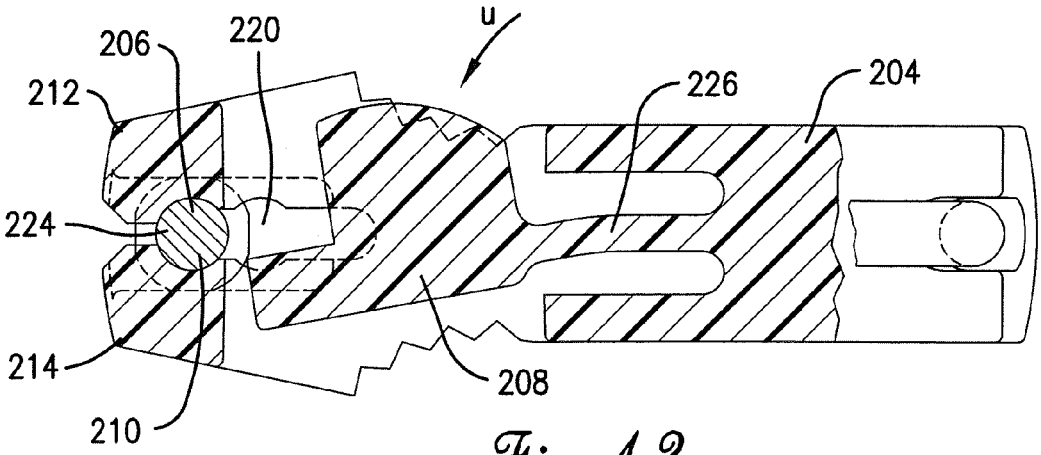
FIG. 12 is a partial cross-sectional view of the connection device similar to FIG. 11, but showing a lock member of the locking mechanism shifted out of the locked position.

The connector 40 is shown open in FIG. 8. When the connector 40 is open, the indexing surfaces 70,72 of the ring projections 66,68 interengage with the upper channel walls 164,166 and the lower channel walls 168,170 to provide an indexing feature of the connector 40. In particular, the upper channel walls 164,166 and the lower channel walls 168,170 engage respective opposite faces 78 of the indexing surfaces 70,72 of the projections 66,68. Preferably the indexing surfaces 70,72 include eight respective faces alternating among substantially flat faces 82 and substantially arcuate faces 84. As shown in FIG. 8, the indexing surfaces 70,72 are configured so that two opposing flat faces 82 simultaneously engage the upper channel walls 164,166 and lower channel walls 168,170. The flat faces 82 cooperate with the substantially flat upper channel walls 164,166 and lower channel walls 168, 170 to preferably define a plurality of indexed positions in which the ring 50 and body 48 are positioned in respective preferred 90°, 180°, and 270° configurations. It is understood that differing face configurations may be utilized to define distinct indexing positions defined by the cooperative engagement of the upper channel walls 164,166 and lower channel walls 168,170 with respective faces of the respective indexing surfaces 70,72.

The indexing functionality is provided at least in part by the flexed arms 116,118, which coordinately urge the opposing upper channel walls 164,166 and lower channel walls 168, 170 toward one another. Further, as the ring 50 swings along the line o, the indexing surfaces 70,72 of the projections 66,68 similarly rotate, causing the arms 116,118 to yieldably flex to a greater degree as a result of the arcuate faces 84 of the indexing surfaces 70,72 camming the respective upper channel walls 164,166 and lower channel walls 168,170 away from one another. As the ring 50 continues to rotate along the line o, there will be an over-center position (corresponding to the mid-point of the arcuate faces 84), at which point further movement of the ring 50 in the direction o will occur automatically as the resiliently flexed arms 116,118 "snap" the ring 50 into the next indexed position. It will be appreciated the swinging of the ring 50 in the opposite direction operates in the same manner. In this manner, the ring 50 and body 48 are relatively swung and urged into and held in one of a plurality of relatively fixed positions defined by each of the plurality of indexed positions.

Objects may be added to or removed from the connector 40 as follows. First, the locking mechanism 142 is disengaged by depressing the actuator 150. Second, while the actuator 150 is depressed, the ring 50 is moved along the slot 124 to move the hinge portion 64 out of the receiving area 128. This slidable movement of the ring 50 also moves the ring ends 56,58 out of the respective recesses 104,106. The user may optionally release the actuator 150 once the hinge portion 64 is located above the lock member 146. Third, the ring 50 and body 48 are relatively swung about the hinged connection 126, thus moving the ring ends 56,58 away from the blocking portion 102 and exposing the ring opening 60. After the ring 50 and body 48 are relatively swung open, the actuator 150 may be released. The flexed arms 116,118 cooperate with the top surface 180 of the lock member 146 and tapered slot 124 to urge the hinge portion 64 back into the receiving area 128. When in this state, the ring 50 and body 48 may be relatively swung and positioned in any of a plurality of indexed positions by the cooperative engagement of flat faces 82 of the indexing surfaces 70,72 with respective upper channel walls 164,166 and lower channel walls 168,170. Finally, objects are received on or removed from respective ring portions 52,54 of the ring 50.

To close the connector 40 (by shifting the ring 50 from the open condition described in the previous paragraph), while depressing the actuator 150 to unlock the connector 40 a user slides the hinge portion 64 along the slot 124 out of the receiving area 128. The user also swings the ring portions 52,54 toward the blocking portion 102 of the body 48 and positions the ring ends 56,58 adjacent the recesses 104,106 of the blocking portion 102. The user then permits the flexing of the arms 116,118 in cooperation with the tapers of the arm walls 120,122 to urge the hinge portion 64 back into the receiving area 128, which urges the blocking portion 102 of the body 48 through the ring opening 60 and the ring ends 56,58 into each of their respective recesses 104,106 thereby closing the connector 40.

A second embodiment is depicted in FIGS. 9-13. The second embodiment has many structural and functional similarities to the first principal embodiment. Therefore, for the sake of brevity, the description of the second embodiment will focus on the significant differences relative to the embodiment shown in FIGS. 1-8. It is initially noted, however, that the connector 200 of the second embodiment similarly includes a ring 202 and a body 204 swingably interconnected at a hinged connection 206. Similar to the first embodiment, the body 204 further includes a locking mechanism 208 for releasably securing the hinged connection 206 in a first position 210 (which can correspond to the closed condition of the connector 200).

Figure 13:
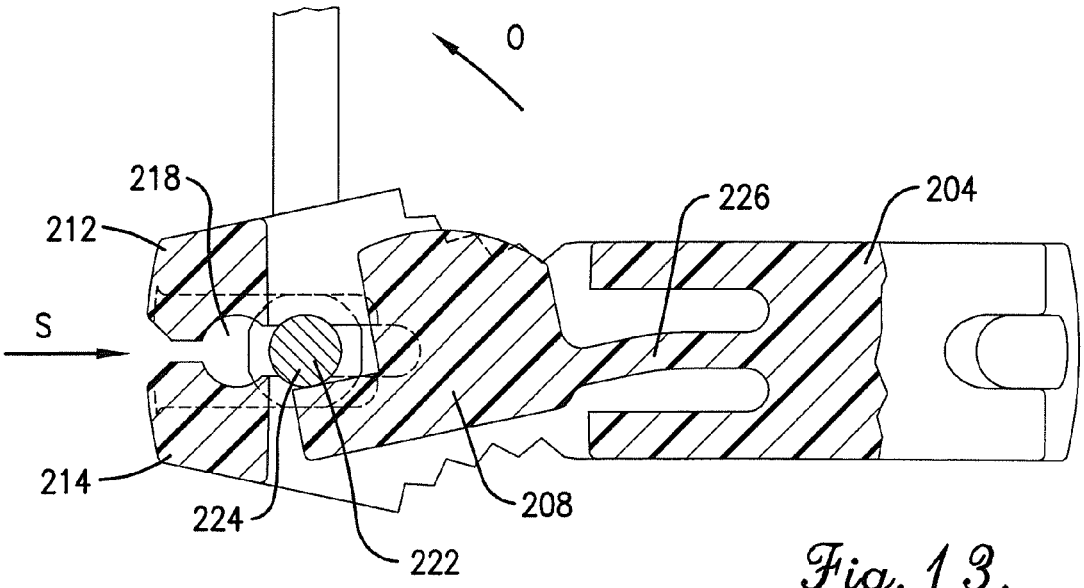
FIG. 13 is a partial cross-sectional view of the connection device similar to FIG. 12, but showing the hinged connection moved to a second position defined by a second detent area of the body.
Figure 14:
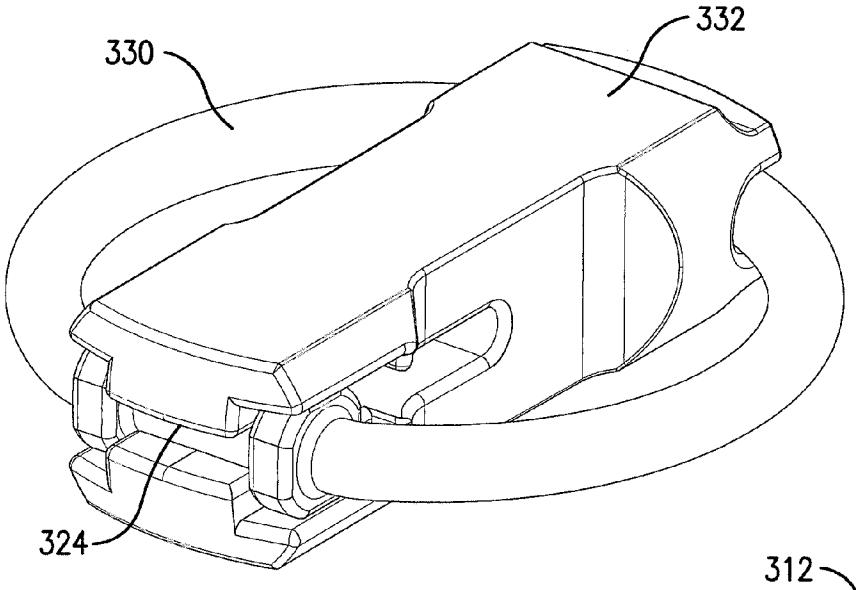
FIG. 14 is perspective view of a third embodiment of the connection device.
Figure 15:
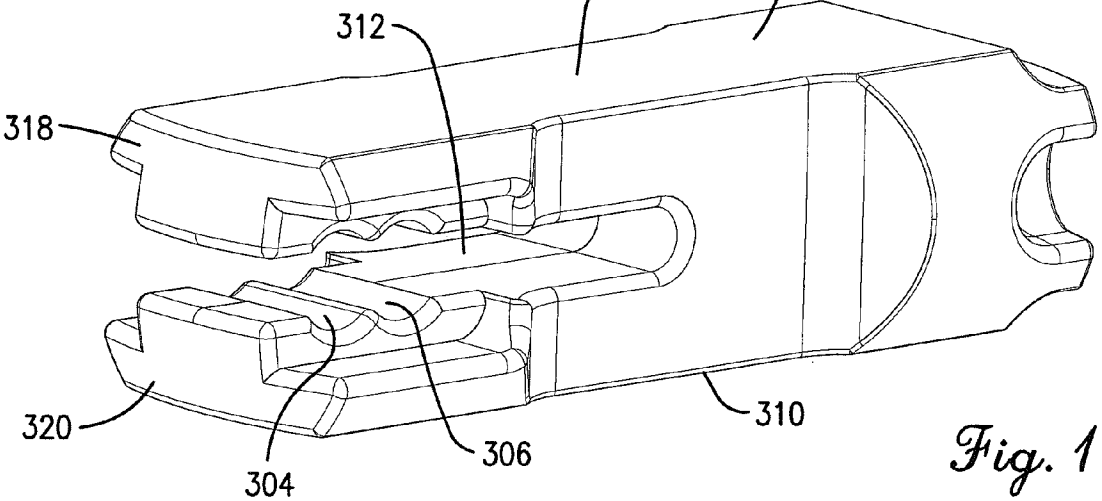
FIG. 15 is a side perspective view of just the body of the connection device depicted in FIG. 14.
Figure 16:
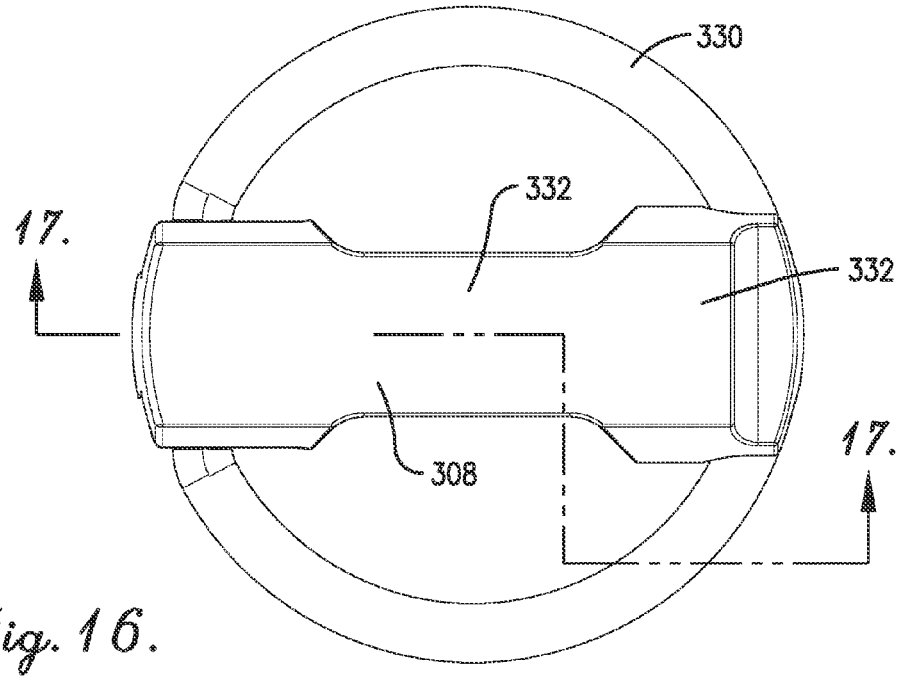
FIG. 16 is a plan view of the connection device depicted in FIGS. 14 and 15.

In the second embodiment, the arms 212,214 of the body 204 define therebetween a slot 216. The slot 216 is, however, preferably not tapered. Spaced along the slot 216 is a first detent area 218 and a second detent area 220, each of which is preferably defined by a pair of opposed detents formed in respective opposing walls of the arms 212,214. The first detent area 218 corresponds with the first position 210 of the hinged connection 206, and the second detent 220 area corresponds with a second position 222 of the hinged connection 206. The detents 218,220 correspond in shape to the hinge portion 224 and are therefore semicircular. However, both could be polygonal. When the locking mechanism 208 is disengaged by applying a force along the line u of FIG. 12, the hinge portion 224 of the ring 202 is moveable within the slot 216 between the detent areas 218,220 by the application of a force s as shown in FIG. 13. In this manner the flexed arms 212,214 cooperatively urge the hinge portion 224 into one of the two respective locations. When the hinged connection 206 is in the second position 222, the ring 202 may be swung in the direction of the line o shown in FIG. 13 to open the connector 200 for addition or removal of objects from the connector 200. It is particularly noted that the bias member 226 of the lock mechanism remains flexed when the hinged connection 206 is in the second position 222. If desired, the hinged connection 206 may be moved back to the first position 210 when adding or removing objects from the opened connector 200 and thereby allow the bias member 226 to return to its unflexed state so that the resiliency of the bias member 226 is not worn out as a result of the hinged connection 206 being located in the second position 222 for an extended amount of time. While the connector 200 is open, a user can add or remove objects from the connector 200 with the hinged connection 206 in the first position 210. To permit closing of the connector 200, the hinged connection 206 is moved back to the second position 222 and the ends of the ring 202 are aligned with corresponding recesses presented by the body 204. The user can then close the connector 200 by shifting the hinged connection 206 back to the first position 210 to securely retain objects on the connector 200 without wearing out the resiliency of the bias member 226.

A third embodiment is depicted in FIGS. 14-19. The third alternative embodiment functions similarly to the second embodiment in the sense that discrete hinge connection positions are defined by detent areas. It is specifically noted that the third embodiment does not include a locking mechanism. Because there is no locking mechanism, the top 308 and bottom 310 surfaces of the body are smooth and preferably generally planar.

Figure 17:
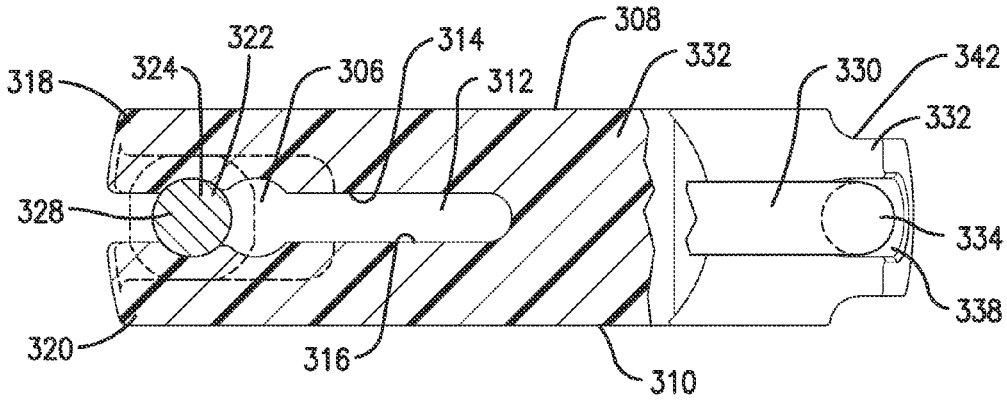
FIG. 17 is a partial cross-sectional view of the connection device taken along line 17-17 of FIG. 16, depicting the hinged connection in the first position.
Figure 18:
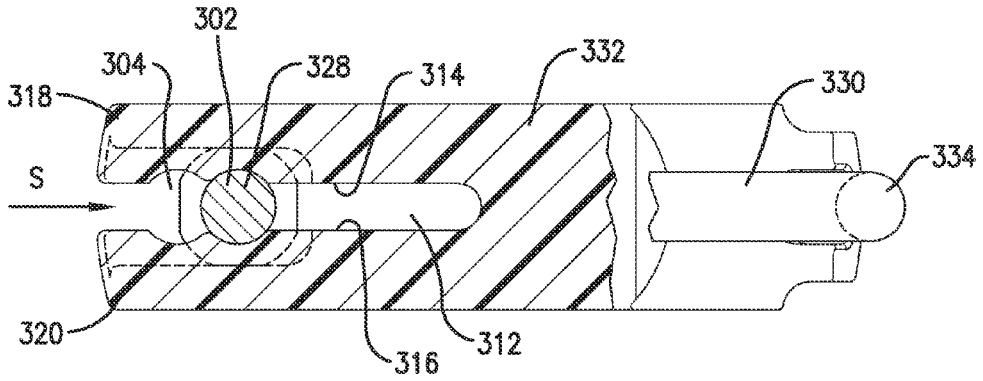
FIG. 18 is a partial cross-sectional view of the connection device similar to FIG. 17, but showing the hinged connection moved to a second position defined by a second detent area of the body.
Figure 19:
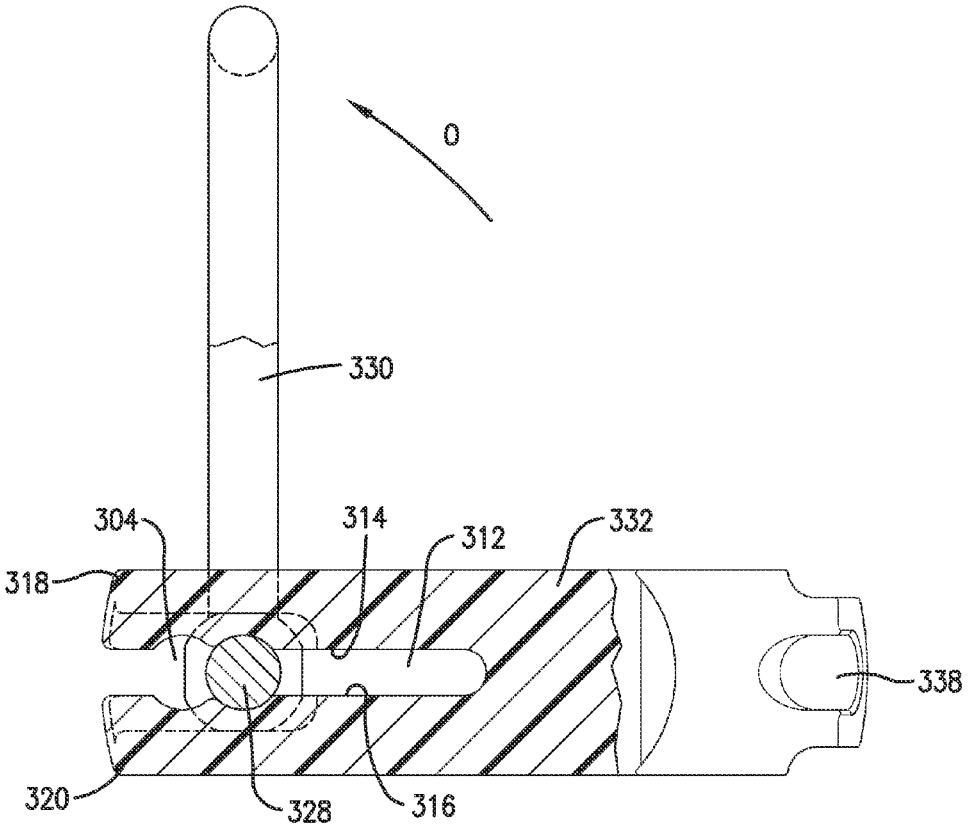
FIG. 19 is a partial cross-sectional view of the connection device similar to FIG. 18, but showing the ring and body relatively swung so that the ring opening is spaced from the blocking portion of the body.
Figure 22:
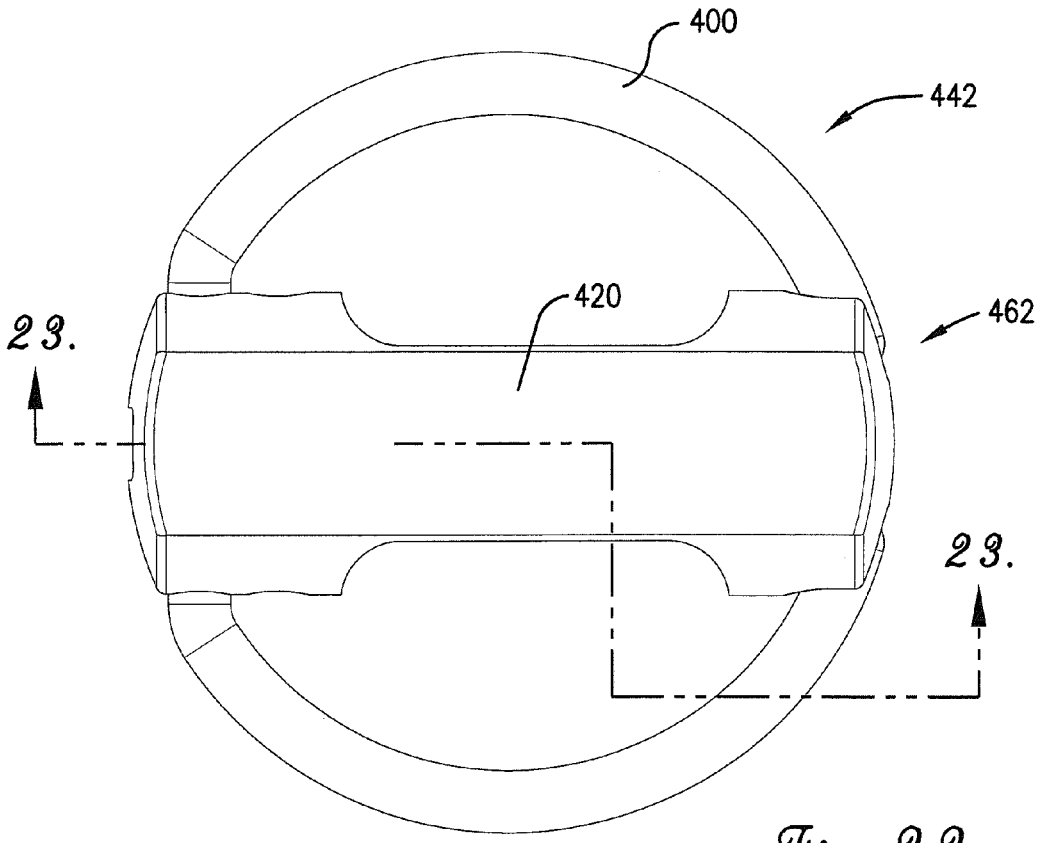
FIG. 22 is a plan view of the connection device depicted in FIGS. 20 and 21.

As perhaps best shown in FIGS. 17-19, spaced along the slot 312 are the first detent area 304 and a second detent area 306, each of which is defined by a pair of detents formed in respective oppositely facing walls 314,316 of the arms 318, 320. As before, the first detent area 304 corresponds with the first position 322 of the hinged connection 324, and the second detent area 306 corresponds with the second hinge position 302 of the hinged connection 324. The hinge portion 328 of the ring 330 is shiftable within the slot 312 between respective detent areas 304,306. Because there is no locking mechanism, the hinge portion 328 of the ring 330 is shiftable within the slot 312 as long as sufficient force is exerted to move the hinge portion 328 out of the respective detent areas 304,306, which also happens to cause the arms 318,320 to resiliently flex to a greater degree. This arrangement reduces the risk of the hinged connection 324 inadvertently moving from the first to second positions. If desired, the body 332 may be formed of a relatively rigid plastic (such as acetal) to restrict flexing of the arms 318,320. As shown in FIG. 19, the body 332 and ring 330 are relatively swingable when the hinged connection 324 is in the second position 302 because the ring ends 334 (with one end not shown) are no longer contained within respective recesses 338 (with one recess not shown) of the blocking portion 342 of the body 332.

A fourth embodiment of the connector 442 is shown in FIGS. 20-24. The fourth embodiment is nearly identical to the third embodiment, except that ring alignment and indexing are accomplished in an alternative manner. In particular, the ring 400 includes only a single projection 402 located intermediate the ends 404,406 of the hinge portion 408. Similar to the double-projection arrangement of the previous embodiments, the alignment surfaces 410,412 of the projection are oppositely facing and preferably substantially perpendicular to the axis of the ring 400. However, the indexing surface 414 of the ring 400 is alternatively configured to include a pair of smaller opposite flat faces 416,418 (corresponding to an aligned condition of the ring 400 and body 420 such as that shown in FIG. 23) and a large flat face 422 and opposite arcuate face 424 (corresponding to the perpendicular open position shown in FIG. 24). Further, smaller arcuate faces 426, 428 are located between the pair of smaller flat faces 416,418 and the larger flat face 422.

The arms 430,432 define a notch 434 running along the length of the body 420 and transecting the arms 430,432. The notch 434 is preferably closed at the top 436 and bottom 438 surfaces of the body 420 such that the notch 434 is open ended and accessible at the hinge end 440 of the body 420. The notch 434 is so dimensioned to complementally receive the single ring projection 402 when the connector 442 is assembled. The arms 430,432 present a pair of oppositely facing interior walls 444,446 that are configured to cooperatively interengage with the ring alignment surfaces 410,412 when the connector 442 is assembled. In particular, the interengagement of the ring alignment surfaces 410,412 with the interior notch-defining walls 444,446 represents another type of alignment feature that operatively prohibits yaw misalignment of the ring 400 and body 420 when the connector 442 is in use.

Figure 23:
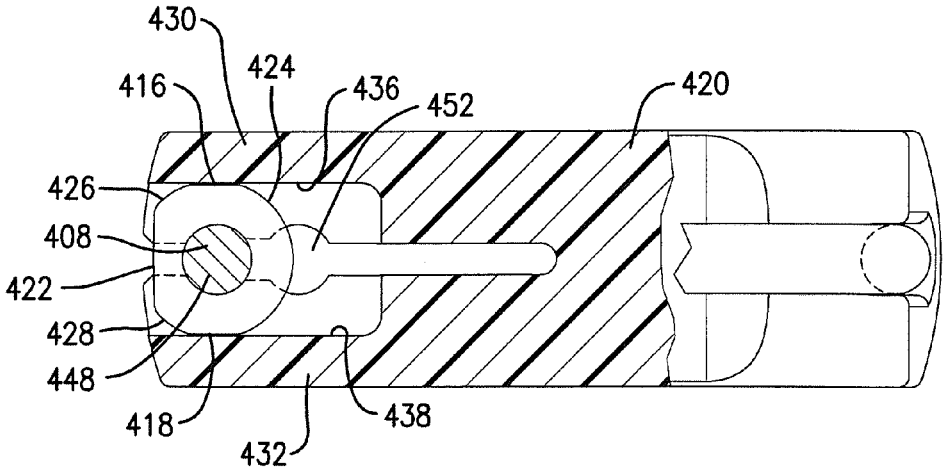
FIG. 23 is a partial cross-sectional view of the connection device taken along line 23-23 of FIG. 22, depicting the hinged connection in the first position.
Figure 24:
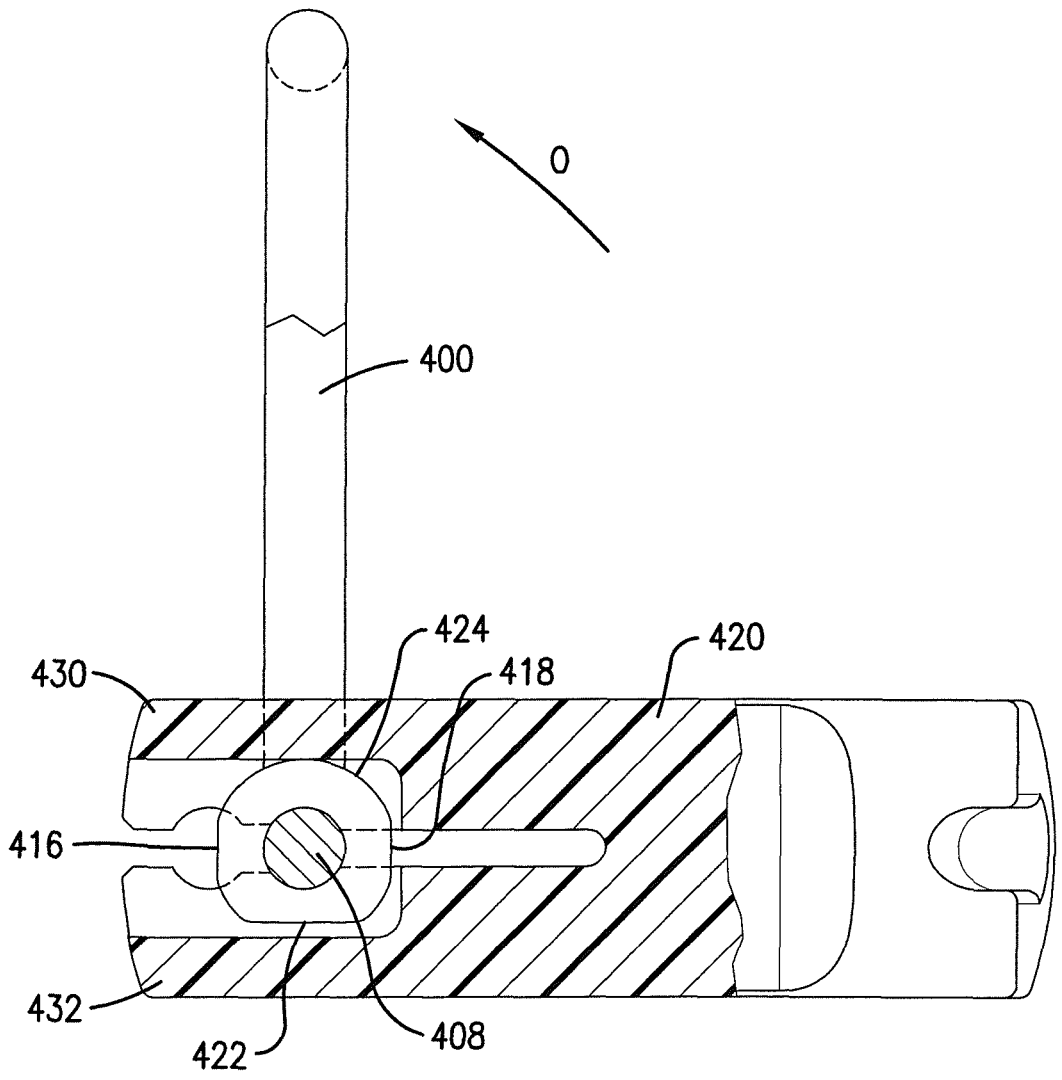
FIG. 24 is a partial cross-sectional view of the connection device similar to FIG. 23, but showing the hinged connection moved to a second position defined by a second detent area of the body and the ring and body relatively swung so that the ring opening is spaced from the blocking portion of the body.

In FIG. 23, the connector 442 is shown in the closed condition in which the ring 400 and body 420 are not relatively swingable. In the closed position, the projection 402 is located entirely within the notch 434 with the major flat face 422 of the indexing surface 414 being spaced from the end of the body. Like the previously discussed embodiments, the hinged connection 448 is shiftable between detent areas 450, 452, with the second detent area 452 (see FIG. 24) permitting relative swinging of the ring 400 and body 420 so that the blocking portion 454 can be removed from the ring opening 456. The first detent area 450 (see FIG. 23) typically corresponds to the connector 442 being closed; however, the hinge portion 408 could be returned to the first detent area 450 after the ring 400 has been swung to the position shown in FIG. 24. In this configuration, the ring 400 will be prevented from swinging 360° relative to the body 420 because the ring ends 458,460 will not be able to swing past the blocking end 462 of the body. To close the connector when the hinge portion 408 is in the first detent area 450, the hinge portion 408 will first have to be moved to the second detent area 452 and the ring 400 and body 420 will have to be axially aligned. As the ring 400 and body 420 are swung relative to one another between the indexed positions, the arcuate faces 424,426, 428 of the indexing surface yieldably flex the arms 430,432 of the body 420. Thus, the flexed arms 430,432 urge the faces of the indexing surface 414 into one of a plurality of respective indexed positions.

Figure 26:
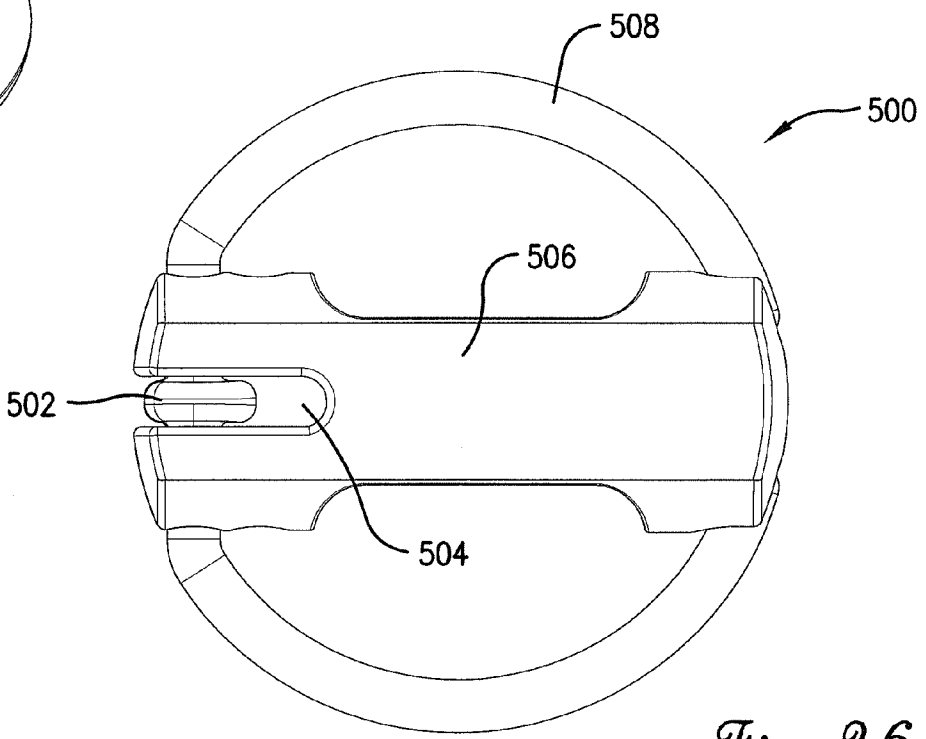
FIG. 26 is a plan view of the connection device depicted in FIG. 25.
Figure 25:
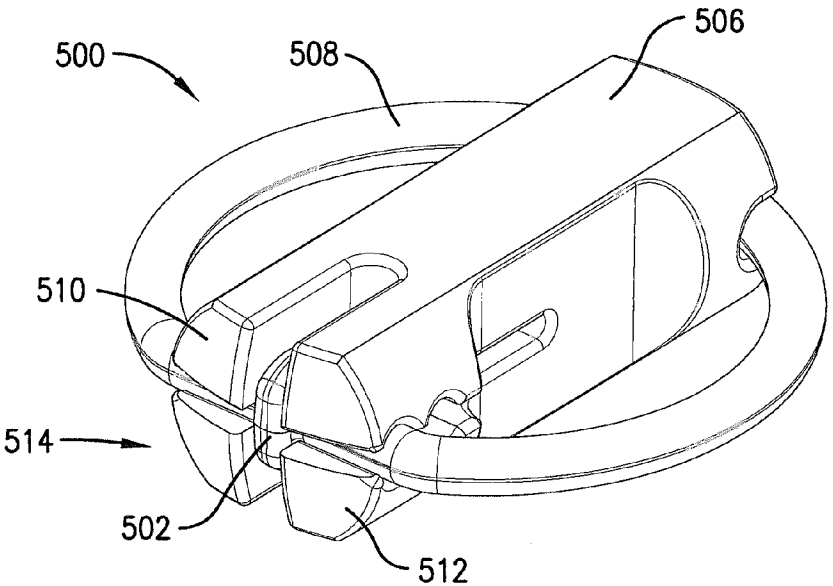
FIG. 25 is a perspective view of a fifth embodiment of the connection device.

A fifth embodiment of a connector 500 is depicted in FIGS. 25 and 26. This embodiment is very similar to that depicted in FIGS. 20-24; however, the single projection 502 is within an open slot 504 of the body 506. Therefore, there is no indexing positioning of the ring 508 and body 506 relative to one another. Although the illustrated projection has a shape similar to that depicted in FIGS. 20-24, it may alternatively have a circular shape (or any shape for that matter) because there is no faceted interengagement with the body. As shown in the top plan view of FIG. 26, the slot 504 passes through the entirety of the arms 510,512 at the hinge end 514 of the body 506.

A sixth embodiment of a connector 600 is shown in FIGS. 27-29. A principal difference of the sixth embodiment is the alignment feature for restricting yaw misalignment of the body 602 and the ring 604.

Notably, the ring 604 does not have a projection, nor does the body include channels or a notch. Rather, the side surfaces 606,608 of the body 602 cooperate with the unique configuration of the ring 604 for accomplishing the alignment feature of the connector 600.

It is noted that the ends 610,612 of the illustrated ring 604 happen to be blunted rather than semispherical, although one of skill in the art would readily recognize that the ring ends 610,612 may have different configurations suitable for their purpose described herein. The ring 604 includes the hinge section 614 slideable within the slot 616 between first and second detent areas 618,620. As with previous embodiments, the hinge section 614 is preferably straight. Moreover, the ring includes a pair of offset sections 622,624 that are axially offset relative to the hinge section 614 and the ring ends 610,612. These offset sections 622,624 form a substantial portion of the arcuate ring portions 630,632. In this embodiment, the offset sections 622,624 are not coplanar, but the hinge section 614 is coplanar with the ring ends 610,612.

Angled junctions 634,636 of the ring 604 are defined at each end of the offset sections 622,624. The outer ring 604 surface along these junctions 634,636 presents the ring alignment surfaces 638,640 which cooperatively interengage with the outer side surfaces 606,608 of the body 602 if there is any relative movement of the ring 604 and body 602 in a yaw misaligning direction. That is, the interengagement of the ring alignment surfaces 638,640 with the respective outer side surfaces 606,608 of the body 602 prohibits yaw misalignment of the blocking portion 642 with respect to the opening 644 of the ring 604 when the connector 600 is in use. Similarly to previously disclosed embodiments, it is understood that the interengagement between the ring alignment surfaces 638, 640 and the outer arm surfaces need not be snug to accomplish satisfactory alignment of the blocking portion 642. Rather, some leeway may exist between the outer side surfaces 606,608 and the respective ring alignment surfaces 638, 640. Furthermore, while the offset sections 622,624 are shown axially offset relative to one another (as previously mentioned), they may alternatively be coplanar relative to one another. For example, the angled junctions 634,636 adjacent the hinge section 614 could alternatively extend in the same direction.

As noted, each offset section 622,624 is associated with an angled junction 634,636 adjacent the corresponding ring ends 610,612 so that the ring ends 610,612 are brought back into axial alignment (see FIG. 29). That is, a countering angled junction 646,648 is provided for each offset section 622,624. Notably, each of the respective recesses 650,652 in the body 602 are also aligned on opposing sides 606,608 of the body 602.

Figure 30:
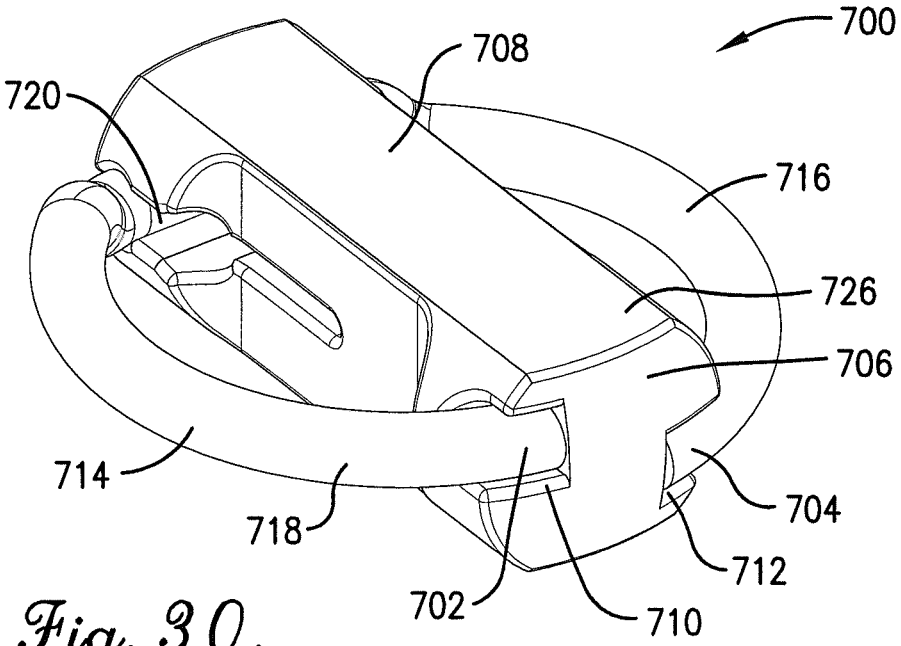
FIG. 30 is a perspective view of a seventh embodiment of the connection device.
Figure 31:
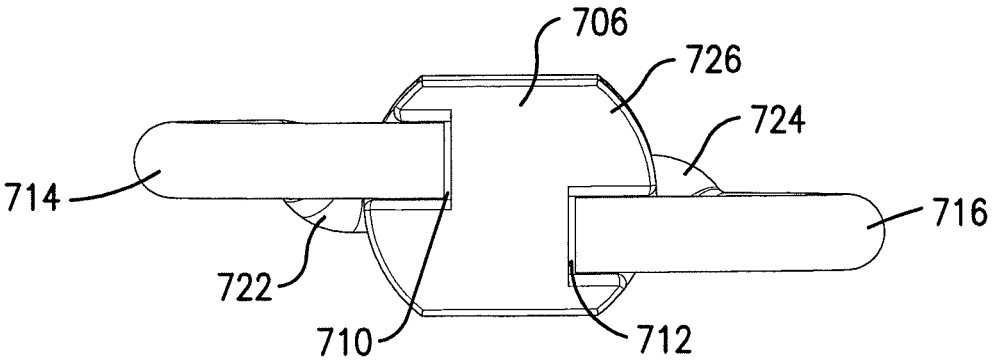
FIG. 31 is an end elevation view of the blocking end of the connection device depicted in FIG. 30, particularly showing the ring ends and the blocking portion of the body spanning the ring opening.
Figure 32:
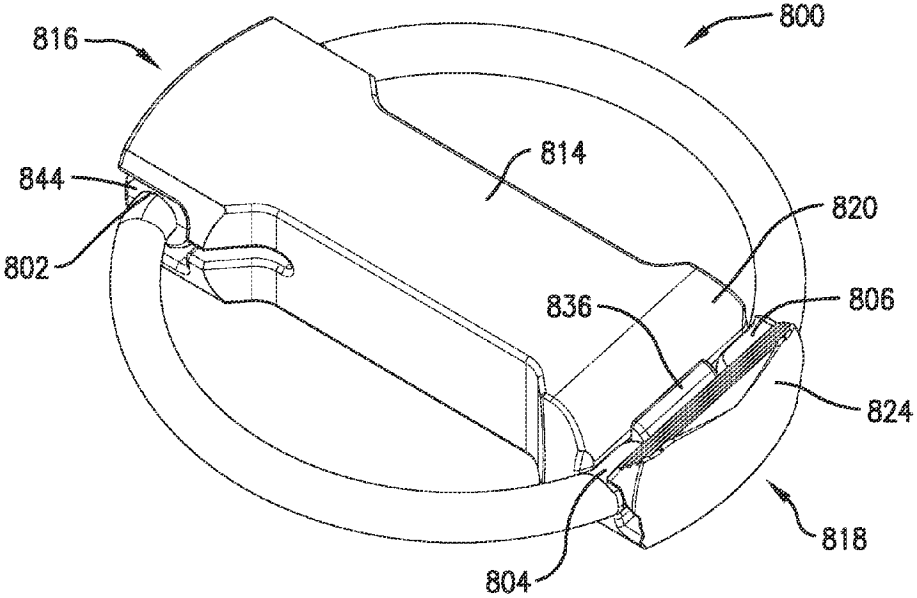
FIG. 32 is top a perspective view of an eighth embodiment of the connection device.
Figure 33:
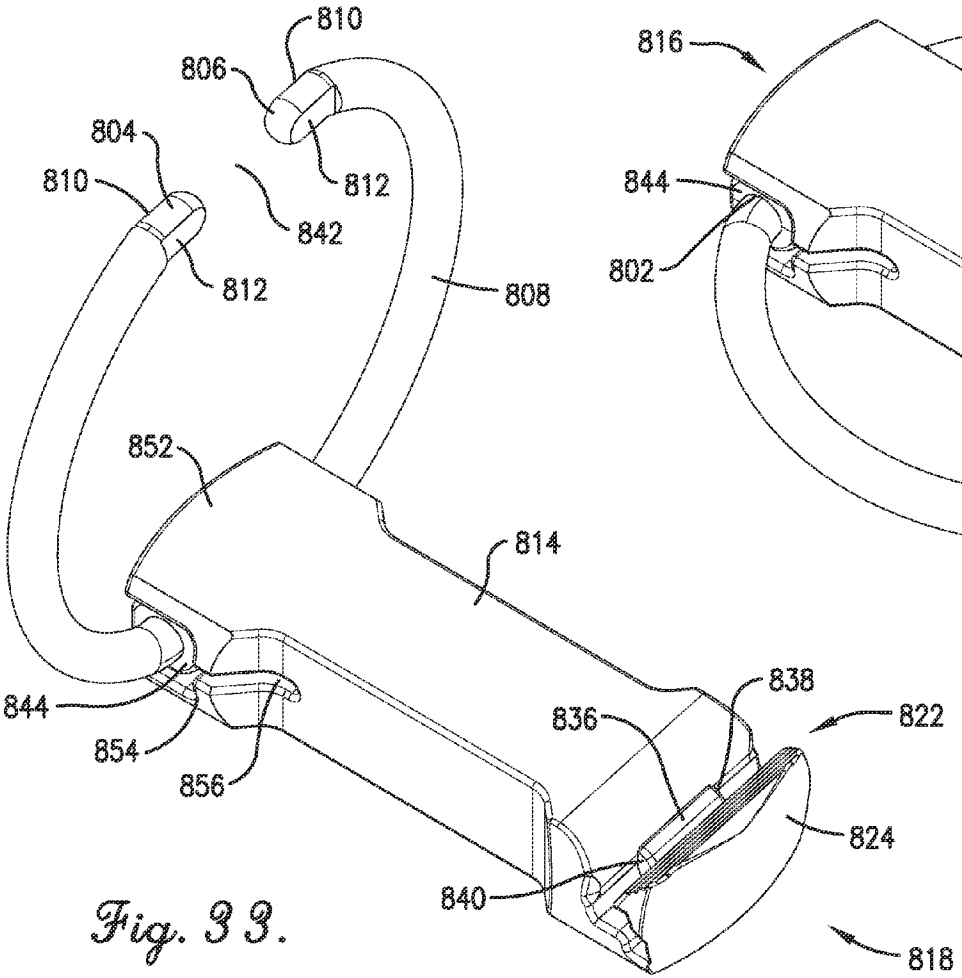
FIG. 33 is a top perspective view of the connection device similar to FIG. 32, but showing the ring and body swung relative to one another.

Turning now to FIGS. 30 and 31, a seventh embodiment of a connector 700 is shown. The connector 700 of the seventh embodiment functions similarly to the sixth embodiment except that the ring ends 702,704 are not brought back into axial alignment. More particularly, the blocking end 706 of the body 708 presents misaligned recesses 710,712 extending inwardly from opposite sides thereof. The offset sections 714,716 of the ring 718 are axially offset relative to the hinge section 720 but continue to and define the ring ends 702,704. In other words, the offset sections 714,716 are associated with countering angled junctions 722,724 adjacent the ring ends 702,704, and the ring ends 702,704 are consequently not aligned with each other. Thus, the misaligned recesses 710, 712 are configured to receive the misaligned ring ends 702, 704 within the blocking portion 726 of the body 708 when the connector 700 is in the closed position as shown in FIG. 31.

An eighth embodiment of a connector 800 is depicted in FIGS. 32-38. Notably, the connector 800 of the eighth embodiment includes a hinged connection 802 that does not move longitudinally along the length of the body 814. The ends 804,806 of the ring 808 are generally semispherically shaped but are modified to present a pair of oppositely facing flat faces 810,812. The body 814 includes a hinge end 816 and blocking end 818, with the blocking end 818 including a blocking portion 820 of the body 814. The blocking portion 820 of the body 814 includes a clasp 822 configured to receive the ring ends 804,806 therein to operably maintain the connector 800 in a closed position. Notably, the ring end faces 810,812 are configured and oriented on the ring ends 804,806 to mateably engage the clasp 822 when the connector 800 is in the closed position as shown in FIGS. 32 and 36-38.

Figure 35:
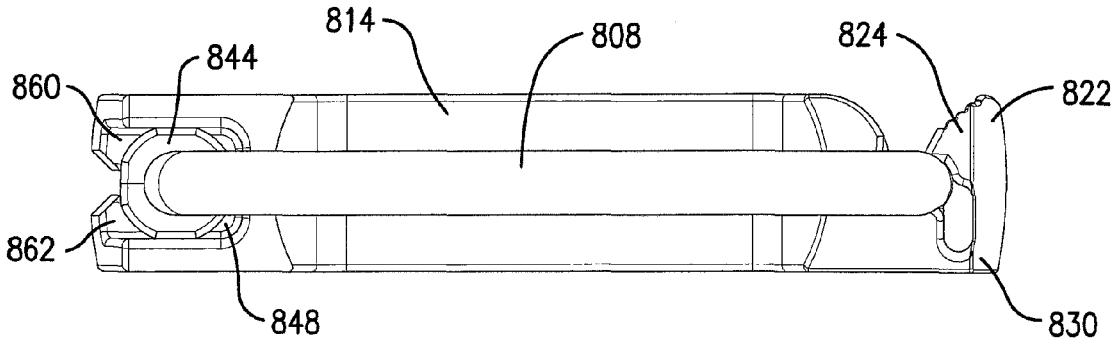
FIG. 35 is a side elevation view of the connection device depicted in FIGS. 32-34.

Referring now to FIGS. 34 and 35, the clasp 822 comprises a catch 824 spaced apart from a fixed seat 826 defined in the blocking portion 820 of the body 814. The catch 824 and fixed seat 826 define a throat 828 therebetween. The throat 828 is operably sized to be slightly smaller than the diameter of the ring ends 804,806. The fixed seat 826 and catch 824 are connected through a resilient biasing element 830. The catch 824 presents a lower face 832 and a cam surface 834 angled upwardly and outwardly from the lower face 832. The cam surface 834 preferably includes corrugations that facilitate operation of the catch 824 when the connector 800 is in use. More particularly, the corrugations prevent a user from unintentionally disengaging the catch 824 when the clasp 822 is in use.

As perhaps best shown in FIG. 34, the clasp 822 further includes a partition 836 projecting from the fixed seat 826 into the throat 828. The partition 836 includes opposing end surfaces 838,840. The opposing end surfaces 838,840 cooperatively interengage with respective ring ends 804,806 to ensure proper yaw alignment of the blocking portion 820 and the ring opening 842 when the connector 800 is closed. The alignment feature provided by the partition ends 838,840 and the ring ends 804,806 preferably assists the ring projections 844 (with one projection not shown) and arm channels 848 (with one channel not shown) in preventing yaw misalignment.

At the hinge end 816 of the body there are a pair of arms 852,854 defining a slot 856 therebetween. A hinge portion (not shown) of the ring 808 (like those previously described with other embodiments of the connector) is received and retained within the slot 856. Unlike previous embodiments of the connector, the hinge portion is not shiftable along the slot 856. Rather, a single hinged connection location is provided within the slot 856 such that the ring 808 and body 814 are relatively swingable. Respective shoulders 860,862 located on the arms 852,854 assist in retaining the hinge portion within the slot 856. Similar to previous embodiments, the connector 800 includes structure to enable appropriate alignment and indexing as previously described. One of skill in the art would readily recognize however that indexing and alignment (if provided) with respect to this embodiment can be accomplished similarly to any of the previously disclosed embodiments and is not limited to any single mode of indexing or/or alignment.

Figure 36:
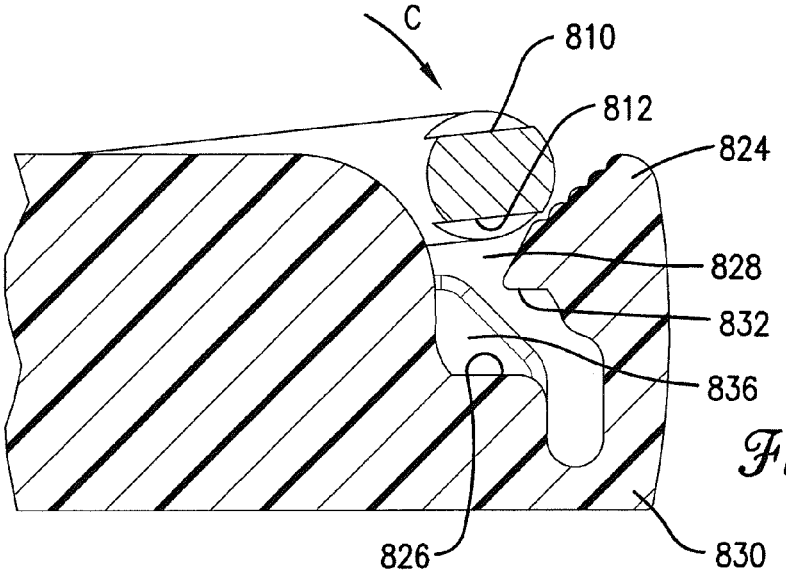
FIG. 36 is an enlarged fragmentary cross-sectional view of the connection device taken along line 38-38 of FIG. 34, particularly depicting the catch in the locking position and relative swinging of the ring and body as the body is placed in the blocking position.

As shown in FIGS. 36 and 37, the ring 808 is being swung relative to the body 814 along the line c to close the connector 800. As the ring ends 804,806 engage the cam surface 834 of the clasp 822, the catch 824 is automatically shifted out of the locked position to permit placement of ring ends 804,806 within the throat 828. That is, continued swinging motion of the ring ends 804,806 along the line c causes a force to be exerted upon the cam surface 834, which communicates such force to the biasing element 830 of the clasp 822 and urges the catch 824 away from the fixed seat 826 along the line b. Continued swinging of the ring 808 along the line c causes the ring ends 804,806 to slide down the cam surface 834 and continuously urge biasing element 830 open to provide ring ends 804,806 access to the throat 828 within the clasp 822.

FIG. 38 shows a partial sectional elevation view of the ring ends 804,806 seated within the clasp 822 on the fixed seat 826. Once the ring ends 804,806 slide along the entirety of the cam surface 834 of the catch 824, the catch 824 is no longer urged outwardly and the biasing element 830 resiliently urges the catch 824 toward the fixed seat 826. Accordingly, the lower face 832 of the catch 824 is engaged with the top flat face 810 of the ring ends 804,806 and the upwardly directed face of the fixed seat 826 is engaged with the bottom face 812 of the ring ends 804,806. Thus, the connector 800 is in the locked position.

To unlock the connecter 800 of the eighth embodiment, a force sufficient to overcome the resilient force of the biasing element 830 is applied along the line b of FIG. 37 such that the catch 824 is moved away from the fixed seat 826 a sufficient distance to permit the respective ring ends 804,806 to freely swing past the catch 824 and be relatively swung away from the clasp 822.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention. Accordingly, the scope of the present invention will be limited only by the claims appended herein.

The inventors hereby state their intent to rely on the Doctrine of Equivalents to determine and assess the reasonably fair scope of the present invention as pertains to any apparatus not materially departing from but outside the literal scope of the invention as set forth in the following claims.

We claim:

1. A connection device for holding an object, such as a key, dog tag, and the like, said connection device comprising:

a ring presenting spaced apart ends defining an opening therebetween, wherein the opening is configured and so dimensioned to receive at least a portion of the object therethrough; and a body including a blocking portion operable to substantially close the ring opening so as to restrict removal of the object from the ring, wherein the body is interconnected with the ring at a hinged connection that forms an axis about which the ring and body are swingable relative to one another, said hinged connection being shiftable in a generally transverse direction relative to the axis between a first position in which the blocking portion blocks said at least a portion of the object from passing through the ring opening and a second position in which the ring and body are relatively swingable about the hinged connection so that the blocking portion may be moved away from the ring to thereby allow access to the opening and removal of the object, said ring and body being configured to prevent relative swinging therebetween when the hinged connection is in the first position, said blocking portion including a first recess configured to receive one of the respective ring ends therein thereby restricting relative swinging of the ring and body when the hinged connection is in the first position.

2. The connection device recited in claim 1, said respective ring end being semispherically shaped.

3. The connection device recited in claim 1, said blocking portion presenting an outer surface, with the recess projecting inwardly from the outer surface, and a first set of chamfers located at the outer surface adjacent to the first recess and configured to guide the ring end into the first recess.

4. The connection device recited in claim 3, said blocking portion including a second recess configured to receive the other respective ring end therein thereby restricting relative swinging of the ring and the body when the hinged connection is in the first position, and said second recess being aligned with the first recess on opposing oppositely facing sides of the outer surface.

5. A connection device for holding an object, such as a key, dog tag, and the like, said connection device comprising:

a ring presenting spaced apart ends defining an opening therebetween, wherein the opening is configured and so dimensioned to receive at least a portion of the object therethrough; and a body including a blocking portion operable to substantially close the ring opening so as to restrict removal of the object from the ring, wherein the body is interconnected with the ring at a hinged connection that forms an axis about which the ring and body are swingable relative to one another, said hinged connection being shiftable in a generally transverse direction relative to the axis between a first position in which the blocking portion blocks said at least a portion of the object from passing through the ring opening and a second position in which the ring and body are relatively swingable about the hinged connection so that the blocking portion may be moved away from the ring to thereby allow access to the opening and removal of the object, said ring presenting a hinge portion that cooperates with the body to define the hinged connection, said ring presenting an arcuate ring portion extending between the hinge portion and one of the ring ends; and said body presenting an elongated side cooperating with the arcuate ring portion to define therebetween a space so as to accommodate the object.

6. The connection device recited in claim 5, said ring and body being configured to prevent relative swinging therebetween when the hinged connection is in the first position.

7. The connection device recited in claim 5, said side including a depression along at least a portion thereof thereby increasing the space between the arcuate ring portion and the side of the body.

8. The connection device recited in claim 5, said body and ring being configured so that the hinged connection is urged into the first position.

9. The connection device recited in claim 5, said ring presenting a pair of ring-alignment surfaces that face in opposite axial directions and extend substantially radially, said body presenting a pair of oppositely facing body surfaces, each of which interengages a respective one of the ring-alignment surfaces so that movement of the body along the ring is generally restricted to thereby ensure alignment of the blocking portion with the opening when the body is in the first position.

10. The connection device recited in claim 9, said ring including a projection that presents ring-alignment surfaces on opposite ends thereof; and said body including a notch defined between the body surfaces, with the notch receiving the projection therein.

11. The connection device recited in claim 9, said ring having a first section and a pair of spaced apart offset sections that are axially offset relative to the first section such that an angled junction is defined between each offset section and the first section.

12. The connection device recited in claim 11, said junctions each defining a respective one of the ring alignment surfaces.

13. The connection device recited in claim 5, said ring being substantially toroidal in shape.

14. The connection device recited in claim 13, said ring including a straight section that cooperates with the body to define the hinged connection.

15. The connection device recited in claim 5, said ring being substantially cylindrical along its circumferential axis.

16. A connection device for holding an object, such as a key, dog tag, and the like, said connection device comprising:

a ring presenting spaced apart ends defining an opening therebetween, wherein the opening is configured and so dimensioned to receive at least a portion of the object therethrough; and a body including a blocking portion operable to substantially close the ring opening so as to restrict removal of the object from the ring, wherein the body is interconnected with the ring at a hinged connection that forms an axis about which the ring and body are swingable relative to one another, said hinged connection being shiftable in a generally transverse direction relative to the axis between a first position in which the blocking portion blocks said at least a portion of the object from passing through the ring opening and a second position in which the ring and body are relatively swingable about the hinged connection so that the blocking portion may be moved away from the ring to thereby allow access to the opening and removal of the object, said body including a manually actuatable locking mechanism that releasably locks the hinged connection in the first position.

17. The connection device recited in claim 16, said ring and body cooperatively defining the hinged connection, with the ring moving between first and second locations relative to the body which correspond to the first and second positions of the hinged connection, said locking mechanism including a lock member shiftable into and out of a locked position in which the lock member engages the ring when the hinged connection is in the first position to thereby prevent movement of the ring out of the first location.

18. The connection device recited in claim 17, said locking mechanism including a bias member that resiliently biases the lock member into the locked position.

19. The connection device recited in claim 18, said locking mechanism including an actuator that is manually depressible, said lock member being shifted against the bias of the bias member when the actuator is depressed.

20. The connection device recited in claim 19, said bias member comprising an elongated element that carries the lock member adjacent a cantilevered end thereof, with the element being supported adjacent an opposite end thereof such that resilient flexing of the element relative to the opposite end permits shifting of the lock member into and out of the locked position.

21. The connection device recited in claim 20, said actuator being supported on the element spaced from the opposite end.

22. The connection device recited in claim 20, said body including a plurality of interior walls that define a cavity in which at least a portion of the locking member is located, with the opposite end of the element projecting from one of the interior walls.

23. The connection device recited in claim 22, said body including an opening that communicates with the cavity, with said actuator projecting through the opening.

24. The connection device recited in claim 16, said locking mechanism being integrally formed with the blocking portion as part of the body.

25. A connection device for holding an object, such as a key, dog tag, and the like, said connection device comprising:

a ring presenting spaced apart ends defining an opening therebetween, wherein the opening is configured and so dimensioned to receive at least a portion of the object therethrough; and a body including a blocking portion operable to substantially close the ring opening so as to restrict removal of the object from the ring, wherein the body is interconnected with the ring at a hinged connection that forms an axis about which the ring and body are swingable relative to one another, said hinged connection being shiftable in a generally transverse direction relative to the axis between a first position in which the blocking portion blocks said at least a portion of the object from passing through the ring opening and a second position in which the ring and body are relatively swingable about the hinged connection so that the blocking portion may be moved away from the ring to thereby allow access to the opening and removal of the object, said ring and body cooperatively defining the hinged connection, with the ring moving between first and second locations relative to the body which correspond to the first and second positions of the hinged connection, said body including arms defining therebetween an elongated slot, with the ring being shiftable within the slot between the first and second locations.

26. The connection device recited in claim 25, said arms engaging the ring and being resiliently flexed when the ring is out of the first location such that the ring is gripped within the slot.

27. The connection device recited in claim 26, said arms including opposing walls that taper away from the first position of the hinged connection and cooperate with the resilient flexing of the arms to guide the hinged connection along the slot from the second position to the first position.

28. The connection device recited in claim 25, said arms defining a first detent area operable to releasably secure the hinged connection in the first position.

29. The connection device recited in claim 28, said arms defining a second detent area operable to releasably secure the hinged connection in the second position.

30. The connection device recited in claim 29, said arms including opposing walls, with each of the detent areas including at least one detent defined along a respective one of the walls.

31. The connection device recited in claim 29, said arms engaging the ring and being resiliently flexed such that the ring is gripped within the slot.

32. The connection device recited in claim 29, said body including a manually actuatable locking mechanism that releasably locks the hinged connection in the first position, said locking mechanism including a lock member shiftable into and out of a locked position in which the lock member engages the ring when the hinged connection is in the first position to thereby prevent movement of the ring out of the first position, said locking mechanism including a bias member that resiliently urges the lock member into the locked position.

33. A connection device for holding an object, such as a key, dog tag, and the like, said connection device comprising:

a ring presenting spaced apart ends defining an opening therebetween, wherein the opening is configured and so dimensioned to receive at least a portion of the object therethrough; and a body including a blocking portion operable to substantially close the ring opening so as to restrict removal of the object from the ring, wherein the body is interconnected with the ring at a hinged connection that forms an axis about which the ring and body are swingable relative to one another, said hinged connection being shiftable in a generally transverse direction relative to the axis between a first position in which the blocking portion blocks said at least a portion of the object from passing through the ring opening and a second position in which the ring and body are relatively swingable about the hinged connection so that the blocking portion may be moved away from the ring to thereby allow access to the opening and removal of the object, said body and ring being configured so that the hinged connection is urged into the first position, said ring and body cooperatively defining the hinged connection, with the ring moving between first and second locations relative to the body which correspond to the first and second positions of the hinged connection, said body including arms defining therebetween an elongated slot, with the ring being shiftable within the slot into and out of the first and second locations.

34. The connection device recited in claim 33, said arms presenting spaced apart distal ends such that the slot is open-ended, said hinged connection being adjacent the open end of the slot when in the first position, said arms engaging the ring and being flexed when the ring is out of the first location to urge the hinged connection to the first position.

35. The connection device recited in claim 33, said arms including opposing walls that define the slot and taper away from the first position of the hinged connection, said walls engaging the ring as the hinged connection is moved along the slot so as to urge the hinged connection to the first position.

36. The connection device recited in claim 35, said arms being configured to exert a force against the ring as the hinged connection is moved along the slot, thereby facilitating urging of the hinged connection to the first position.

37. The connection device recited in claim 36, said arms being resiliently flexed when the ring is out of the first location to generate the force exerted against the ring.

38. The connection device of claim 33, said body including a manually actuatable locking mechanism that releasably locks the hinged connection in the first position, said locking mechanism including a lock member shiftable into and out of a locked position in which the lock member engages the ring when the hinged connection is in the first position to thereby prevent movement of the ring out of the first location, said locking mechanism including a bias member that resiliently urges the lock member into the locked position, said lock member contacting the ring when the ring is in the second location.

39. A connection device for holding an object, such as a key, dog tag, and the like, said connection device comprising:

a ring presenting spaced apart ends defining an opening therebetween, wherein the opening is configured and so dimensioned to receive at least a portion of the object therethrough; and a body including a blocking portion operable to substantially close the ring opening so as to restrict removal of the object from the ring, wherein the body is interconnected with the ring at a hinged connection that forms an axis about which the ring and body are swingable relative to one another, said hinged connection being shiftable in a generally transverse direction relative to the axis between a first position in which the blocking portion blocks said at least a portion of the object from passing through the ring opening and a second position in which the ring and body are relatively swingable about the hinged connection so that the blocking portion may be moved away from the ring to thereby allow access to the opening and removal of the object, said ring presenting a pair of ring-alignment surfaces that face in opposite axial directions and extend substantially radially, said body presenting a pair of oppositely facing body surfaces, each of which interengages a respective one of the ring-alignment surfaces so that movement of the body along the ring is generally restricted to thereby ensure alignment of the blocking portion with the opening when the body is in the first position, said blocking portion including a first recess configured to receive one of the respective ring ends therein thereby restricting relative swinging of the ring and body when the hinged connection is in the first position.

40. A connection device for holding an object, such as a key, dog tag, and the like, said connection device comprising:

a ring presenting spaced apart ends defining an opening therebetween, wherein the opening is configured and so dimensioned to receive at least a portion of the object therethrough; and a body including a blocking portion operable to substantially close the ring opening so as to restrict removal of the object from the ring, wherein the body is interconnected with the ring at a hinged connection that forms an axis about which the ring and body are swingable relative to one another, said hinged connection being shiftable in a generally transverse direction relative to the axis between a first position in which the blocking portion blocks said at least a portion of the object from passing through the ring opening and a second position in which the ring and body are relatively swingable about the hinged connection so that the blocking portion may be moved away from the ring to thereby allow access to the opening and removal of the object, said ring presenting a pair of ring-alignment surfaces that face in opposite axial directions and extend substantially radially;

said body presenting a pair of oppositely facing body surfaces, each of which interengages a respective one of the ring-alignment surfaces so that movement of the body along the ring is generally restricted to thereby ensure alignment of the blocking portion with the opening when the body is in the first position, said ring presenting a pair of spaced apart projections that cooperatively present the ring alignment surfaces along opposed faces thereof.

41. A connection device for holding an object, such as a key, dog tag, and the like, said connection device comprising:

a ring presenting spaced apart ends defining an opening therebetween, wherein the opening is configured and so dimensioned to receive at least a portion of the object therethrough; and a body including a blocking portion operable to substantially close the ring opening so as to restrict removal of the object from the ring, wherein the body is interconnected with the ring at a hinged connection that forms an axis about which the ring and body are swingable relative to one another, said hinged connection being shiftable in a generally transverse direction relative to the axis between a first position in which the blocking portion blocks said at least a portion of the object from passing through the ring opening and a second position in which the ring and body are relatively swingable about the hinged connection so that the blocking portion may be moved away from the ring to thereby allow access to the opening and removal of the object, said ring presenting a body-engaging surface, said body including a pair of flexible arms, with each of said flexible arms including a wall engaging the body-engaging surface of the ring to thereby releasably retain the body and the ring in one of a plurality of indexed positions, with relative swinging of the body and ring between positions causing the arms to yieldably flex.

42. The connection device recited in claim 41, said body-engaging surface of the ring being polygonal in shape and presenting numerous faces.

43. The connection device recited in claim 42, said faces of the body-engaging surface alternating among substantially arcuate faces and substantially flat faces.

44. A connection device for holding an object, such as a key, dog tag, and the like, said connection device comprising:

a ring presenting spaced apart ends defining an opening therebetween, wherein the opening is configured and so dimensioned to receive at least a portion of the object therethrough; and a body including a blocking portion operable to substantially close the ring opening so as to restrict removal of the object from the ring, wherein the body is interconnected with the ring at a hinged connection that forms an axis about which the ring and body are swingable relative to one another, said hinged connection being shiftable in a generally transverse direction relative to the axis between a first position in which the blocking portion blocks said at least a portion of the object from passing through the ring opening and a second position in which the ring and body are relatively swingable about the hinged connection so that the blocking portion may be moved away from the ring to thereby allow access to the opening and removal of the object, said ring being substantially toroidal in shape, said ring including a straight section that cooperates with the body to define the hinged connection, said ring further including a pair of arcuate sections each extending between the straight section and a respect one of the ends.

45. A connection device for holding an object, such as a key, dog tag, and the like, said connection device comprising:

a ring presenting spaced apart ends defining an opening therebetween, wherein the opening is configured and so dimensioned to receive at least a portion of the object; and a body swingably interconnected with the ring about a hinged connection so that the body may be swung into and out of a blocking position relative to the opening to thereby prevent removal of the object, said ring presenting a body-engaging ring surface, said body including a pair of flexible arms, with each of said flexible arms including a wall engaging the ring surface to cooperatively define the hinged connection, said ring surface presenting a plurality of ring faces and said walls each having a wall face engaging the surface to thereby releasably retain the body and ring in one of a plurality of indexed positions, with relative swinging of the body and ring between the positions causing the arms to yieldably flex.

46. The connection device recited in claim 45, said ring surface being generally polygonal in shape.

47. The connection device recited in claim 45, said ring faces including at least one substantially flat face.

48. The connection device recited in claim 45, said faces of the ring surface alternating among substantially flat faces and substantially arcuate faces with each of the substantially flat faces corresponding to one of each of the indexed positions.

49. The connection device recited in claim 48, said wall faces each being substantially flat.

50. The connection device recited in claim 48, said ring and body being oriented substantially perpendicular to each other when in one of the respective indexed positions.

51. The connection device recited in claim 45, said hinged connection being movable between a first position in which the body is in the blocking position and a second position in which the body is swingable relative to the ring out of the blocking position to permit removal of the object from the ring.

52. The connection device recited in claim 51, said ring and body being configured to prevent relative swinging therebetween when the hinged connection is in the first position.

53. The connection device recited in claim 52, said body including a blocking portion operable to substantially close the ring opening when the body is in the blocking position, said blocking portion including a first recess configured to receive one of the respective ring ends therein thereby restricting relative swinging of the ring and body when the hinged connection is in the first position.

54. The connection device recited in claim 51, said body including a manually actuatable locking mechanism that releasably locks the hinged connection in the first position.

55. The connection device recited in claim 54, said ring and body cooperatively defining the hinged connection, with the ring moving between first and second locations relative to the body which correspond to the first and second positions of the hinged connection, said locking mechanism including a lock member shiftable into and out of a locked position in which the lock member engages the ring when the hinged connection is in the first position to thereby prevent movement of the ring out of the first location.

56. The connection device recited in claim 55, said locking mechanism including a bias member that resiliently urges the lock member into the locked position.

57. The connection device recited in claim 51, said body and ring being configured so that the hinged connection is urged into the first position.

58. The connection device recited in claim 57, said ring and body cooperatively defining the hinged connection, with the ring moving between first and second locations relative to the body which correspond to the first and second positions of the hinged connection, said arms defining therebetween an elongated slot, with the ring being shiftable within the slot into and out of the first and second locations.

59. The connection device recited in claim 58, said arms presenting spaced apart distal ends such that the slot is open-ended, said hinged connection being adjacent the open end of the slot when in the first position, said arms being flexed when the ring is out of the first location to urge the hinged connection to the first position.

60. The connection device recited in claim 58, said walls taper away from the first position of the hinged connection, said walls engaging the ring as the hinged connection is moved along the slot.

61. The connection device recited in claim 60, said arms being configured to exert a force against the ring as the hinged connection is moved along the slot.

62. The connection device recited in claim 51, said arms defining a first detent area operable to releasably secure the hinged connection in the first position.

63. The connection device recited in claim 51, said body including a blocking portion operable to substantially close the ring opening when the body is in the blocking position, said ring presenting a pair of ring-alignment surfaces that face in opposite axial directions and extend substantially radially; and said body presenting a pair of oppositely facing body surfaces, each of which interengages a respective one of the ring-alignment surfaces so that movement of the body along the ring is generally restricted to thereby ensure alignment of the blocking portion with the opening when the body is in the first position.

64. The connection device recited in claim 63, said blocking portion including a first recess configured to receive one of the respective ring ends therein thereby restricting relative swinging of the ring and body when the hinged connection is in the first position.

65. The connection device recited in claim 63, said ring presenting a pair of spaced apart projections that cooperatively present the ring-alignment surfaces along opposed faces thereof.

66. The connection device recited in claim 65, said projections having an outer circumferential wall that defines the body-engaging ring surface.

67. A connection device for holding an object, such as a key, dog tag, and the like, said connection device comprising:

a ring having ends operable to define an opening therebetween that is configured to receive at least a portion of the object therethrough, said ring including a hinge portion spaced from the ends; and a body cooperating with the hinge portion of the ring to define a hinged connection that forms an axis about which the ring and body are swingable relative to one another, said hinged connection being shiftable in a generally transverse direction relative to the axis between first and second positions spaced along the body, with the ends being moveable into engagement with the body when the hinged connection is in the first position and the ends being spaced from the body when the hinged connection is in the second position.

68. The connection device recited in claim 57,
said ends of the ring being permanently spaced apart.

69. The connection device recited in claim 68,
said body including a blocking portion operable to substantially close the ring opening so as to restrict removal of the object from the ring when the hinged connection is in the first position and the ends are moved into engagement with the blocking portion.

70. The connection device recited in claim 69,
said blocking portion including first and second recesses, each being configured to receive a respective one of the ring ends therein thereby restricting relative swinging of the ring and body when the hinged connection is in the first position.

71. The connection device recited in claim 67,
said ring and body being configured to prevent relative swinging therebetween when the hinged connection is in the first position and the ends are moved into engagement with the body.

72. The connection device recited in claim 71,
said body including a recess configured to receive at least one of the ends of the ring therein thereby restricting relative swinging of the ring and body when the hinged connection is in the first position.

73. The connection device recited in claim 67,
said ring presenting an arcuate ring portion extending between the hinge portion and one of the ring ends,
said body presenting an elongated side cooperating with the arcuate ring portion to define therebetween a space so as to accommodate the object.

74. The connection device recited in claim 73,
said side including a depression along at least a portion thereof thereby increasing the space between the arcuate ring portion and the side of the body.

75. The connection device recited in claim 67,
said body including a manually actuatable locking mechanism that releasably locks the hinged connection in the first position.

76. The connection device recited in claim 75,
said ring moving between first and second locations relative to the body, with said locations corresponding to the first and second positions of the hinged connection,
said locking mechanism including a lock member shiftable into and out of a locked position in which the lock member engages the ring when the hinged connection is in the first position to thereby prevent movement of the ring out of the first location.

77. The connection device recited in claim 76,
said locking mechanism including a bias member that resiliently urges the lock member into the locked position.

78. The connection device recited in claim 77,
said locking mechanism including an actuator that is manually depressible,
said lock member being shifted against the bias member when the actuator is depressed.

79. The connection device recited in claim 78,
said bias member comprising an elongated element that carries the lock member adjacent a cantilevered end thereof, with the element being supported adjacent an opposite end thereof such that resilient flexing of the element relative to the opposite end permits shifting of the lock member into and out of the locked position.

80. The connection device recited in claim 79,
said actuator being supported on the element spaced from the opposite end thereof.

81. The connection device recited in claim 79,
said body including a plurality of interior walls that define a cavity in which at least a portion of the lock member is located, with the opposite end of the element projecting from one of the interior walls.

82. The connection device recited in claim 81,
said body including an opening that communicates with the cavity, with said actuator projecting through the opening.

83. The connection device recited in claim 67,
said ring moving between first and second locations relative to the body, with said locations corresponding to the first and second positions of the hinged connection,
said body including arms defining therebetween an elongated slot, with the ring being shiftable within the slot between the first and second locations.

84. The connection device recited in claim 83,
said arms engaging the ring and being resiliently flexed when the ring is out of the first location such that the ring is gripped within the slot.

85. The connection device recited in claim 83,
said arms defining a first detent area operable to releasably secure the hinged connection in the first position,
said arms defining a second detent area operable to releasably secure the hinged connection in the second position.

86. The connection device recited in claim 83,
said body and ring being configured so that the hinged connection is urged into the first position.

87. The connection device recited in claim 86,
said arms including opposing walls that define the slot and taper away from the first position of the hinged connection,
said walls engaging the ring as the hinged connection is moved along the slot so as to urge the hinged connection to the first position.

88. The connection device recited in claim 87,
said arms being configured to exert a force against the ring as the hinged connection is moved along the slot, thereby facilitating urging of the hinged connection to the first position.

89. The connection device recited in claim 67,
said ring presenting a pair of ring-alignment surfaces that face in opposite axial directions and extend substantially radially; and
said body presenting a pair of oppositely facing body surfaces, each of which interengages a respective one of the ring-alignment surfaces so that movement of the body along the ring is generally restricted to thereby ensure proper alignment of the ring relative to the body.

90. The connection device recited in claim 67,
said ring presenting a body-engaging surface; and
said body including a pair of flexible arms, with said flexible arms including a wall engaging the body-engaging surface of the ring to thereby releasably retain the body and the ring in one of a plurality of indexed positions, with relative swinging of the body and ring between positions causing the arms to yieldably flex.

91. The connection device recited in claim 90,
said body-engaging surface of the ring being polygonal in shape and presenting numerous faces.

* * * * *